US009782666B2

(12) United States Patent
Dahl et al.

(10) Patent No.: US 9,782,666 B2
(45) Date of Patent: Oct. 10, 2017

(54) MECHANICAL PROJECTILE AND TARGET GAME

(71) Applicant: Scienz Group L.L.C., Minneapolis, MN (US)

(72) Inventors: Derek George Dahl, Minneapolis, MN (US); Samuel David Buss, Minneapolis, MN (US)

(73) Assignee: Scienz Group L.L.C., Minneapolis, MN (US)

( * ) Notice: Subject to any disclaimer, the term of this patent is extended or adjusted under 35 U.S.C. 154(b) by 0 days.

(21) Appl. No.: 14/550,875

(22) Filed: Nov. 21, 2014

(65) Prior Publication Data

US 2015/0137452 A1 May 21, 2015

Related U.S. Application Data

(60) Provisional application No. 61/906,994, filed on Nov. 21, 2013.

(51) Int. Cl.

| | |
|---|---|
| ***A63F 7/00*** | (2006.01) |
| ***A63F 7/24*** | (2006.01) |
| ***A63B 67/06*** | (2006.01) |
| ***A63B 69/40*** | (2006.01) |
| *A63B 63/08* | (2006.01) |
| *A63F 7/40* | (2006.01) |
| *A63F 9/00* | (2006.01) |
| *A63B 71/00* | (2006.01) |

(52) U.S. Cl.

CPC ..... *A63F 7/0017* (2013.01); *A63B 67/06* (2013.01); *A63B 69/40* (2013.01); *A63B 69/408* (2013.01); *A63F 7/249* (2013.01); *A63B 63/08* (2013.01); *A63B 71/0036* (2013.01); *A63B 2069/401* (2013.01); *A63B 2207/02* (2013.01); *A63B 2209/08* (2013.01); *A63B 2210/50* (2013.01); *A63B 2220/801* (2013.01); *A63B 2220/833* (2013.01); *A63F 2007/4087* (2013.01); *A63F 2009/0012* (2013.01); *A63F 2250/024* (2013.01); *A63F 2250/54* (2013.01)

(58) Field of Classification Search

CPC ..... A63B 67/00; A63B 69/0079; A63F 9/02
USPC ..... 273/342, 331, 317.7, 317.8, 329, 397, 273/348.3, 371, 398–402, 119 R, 118 R, 273/108.53, 108.52, 337, 355, 364, 405, 273/108.56; 446/485, 175, 219, 337, 355, 446/364, 405, 108.56

See application file for complete search history.

(56) References Cited

U.S. PATENT DOCUMENTS

| | | | |
|---|---|---|---|
| 3,208,444 | A | 9/1965 | Sipos |
| 3,446,199 | A | 5/1969 | Saveca |

(Continued)

*Primary Examiner* — Aarti B Berdichevsky
*Assistant Examiner* — Rayshun Peng
(74) *Attorney, Agent, or Firm* — Krenz Patent Law, LLC

(57) ABSTRACT

In one implementation, a game apparatus includes a base with a playing surface that has (i) a first end with a first designated area for cups and (ii) a second end; a game piece; a tether that attaches the game piece to the base so as to permit the game piece to move freely within the tether's range; and a first launcher that includes a mechanism to launch the game piece as a projectile, the first launcher being positioned at or around the second end to launch the game piece toward the first designated area for cups, wherein the first designated area for cups and at least a portion of the first launcher are within the tether's range.

24 Claims, 15 Drawing Sheets

(56) References Cited

U.S. PATENT DOCUMENTS

| | | | | | |
|---|---|---|---|---|---|
| 3,450,406 | A * | 6/1969 | Brown | A63D 5/00 | 206/315.1 |
| 3,669,451 | A | 6/1972 | Welbourne | | |
| 3,724,855 | A | 4/1973 | Chu | | |
| 3,777,733 | A | 12/1973 | Mitchell | | |
| 3,901,508 | A | 8/1975 | Spangler | | |
| 4,010,953 | A | 3/1977 | Russo | | |
| 4,039,188 | A * | 8/1977 | Goldfarb | A63F 9/02 | 273/127 D |
| 4,261,577 | A * | 4/1981 | Ellis | A63F 7/249 | 124/7 |
| 4,270,757 | A * | 6/1981 | Ligon | A63B 69/0079 | 473/465 |
| 4,872,679 | A * | 10/1989 | Bohaski | A63F 7/0668 | 273/108 |
| 5,104,124 | A | 4/1992 | Bernard et al. | | |
| 5,288,071 | A | 2/1994 | Solomon | | |
| 5,344,156 | A * | 9/1994 | Levin | A63F 7/045 | 273/350 |
| 5,435,570 | A | 7/1995 | Labrasseur | | |
| D366,908 | S | 2/1996 | Crennen | | |
| D368,280 | S | 3/1996 | Brown | | |
| D398,937 | S | 9/1998 | Spikes | | |
| 5,967,513 | A * | 10/1999 | Wells | A63F 9/02 | 273/108.1 |
| 6,102,405 | A | 8/2000 | Spikes | | |
| 7,325,807 | B1 | 2/2008 | Eason | | |
| RE40,580 | E | 11/2008 | Mitvalsky | | |
| 7,516,960 | B1 | 4/2009 | Battiste | | |
| 7,805,959 | B2 | 10/2010 | Webb et al. | | |
| 8,006,980 | B1 | 8/2011 | Herro et al. | | |
| 8,176,745 | B1 | 5/2012 | Korza et al. | | |
| 8,205,887 | B2 | 6/2012 | Wyland | | |
| D697,432 | S | 1/2014 | Dahl et al. | | |
| 8,727,918 | B1 * | 5/2014 | Gentile | A63B 43/06 | 473/570 |
| 2004/0188942 | A1 | 9/2004 | Trokan | | |
| 2005/0029747 | A1 | 2/2005 | Grayson | | |
| 2006/0226606 | A1 * | 10/2006 | Finley | A63B 67/002 | 273/342 |
| 2009/0194941 | A1 | 8/2009 | Boyd et al. | | |
| 2010/0148434 | A1 | 6/2010 | Brustmeyer | | |
| 2011/0204570 | A1 | 8/2011 | Lombardi | | |
| 2011/0281661 | A1 * | 11/2011 | Gormley | A63B 43/007 | 473/147 |
| 2014/0252718 | A1 * | 9/2014 | Rieman | A63B 67/007 | 273/342 |

* cited by examiner 705
704
702
701

704
702
705
701
703

700
705
701
706
704
702

MECHANICAL PROJECTILE AND TARGET GAME

CROSS-REFERENCE TO RELATED APPLICATIONS

This application claims priority to U.S. Provisional Application Ser. No. 61/906,994, which is entitled "Mechanical Table-Top Projectile and Target Game" and was filed on Nov. 21, 2013, the entire contents of which are hereby incorporated by reference.

TECHNICAL FIELD

The present disclosure generally pertains to game apparatuses with mechanical projectile launching devices and associated methods of play.

BACKGROUND

Records of drinking games date back to ancient societies as early as the $10^{th}$ century BC. Recently, one game in particular, "Beer Pong," also known as "Beirut," has become especially popular amongst college students and bar-goers alike. The game is typically played on an elongated planar surface, such as a table tennis or ping pong table with the center net removed or a sheet of plywood elevated to waist level to form a table. Near each lengthwise end of the table, cups are arranged in a triangular fashion and filled with a liquid of choice, such as beer. The liquid helps anchor and stabilize the typically lightweight plastic cups. Two opposing teams usually consisting of two participants each attempt to manually throw, toss, or bounce pong balls into the target cups at the opposite end of the table. With each successful throw, toss, or bounce, defined by landing the ball in a cup, participants on the opposing team remove sunken cups from play and may consume the contents of the cup. The objective of the game is to eliminate the opposing team's cups until none remain in play.

SUMMARY

This document generally describes apparatuses, devices, and systems for use playing projectile and target games, such as beer pong. For example, methods of play involving the use of such apparatuses, devices, and systems can include the use of launchers to launch game pieces, such as balls, as projectiles at a plurality of open targets, such as cups which may be partially filled with liquid. Playing surfaces, such as game boards, can include a plurality of cup-receiving recesses disposed at both ends.

Playing surfaces, such as game boards, can consist of an elongated planar top surface with a longitudinal axis extending between a first end and a second end. A bottom surface can be juxtaposed away from the top surface. An array of recesses, extruded from the top surface towards the bottom surface, can be disposed at both the first end and second end. Such recesses can be specifically sized to be occupied by the target cups and launchers, and can provide stability and/or definite positions for both the target cups and projectile launchers. The location of each cup-receiving recess can be specifically positioned to provide multiple different cup positioning (e.g., racking, re-racking) options. The cup-receiving recesses can be geometrically spaced such that the top plane or lip of each cup is near, touching, or tangent to adjacent cups for a given racking or re-racking configuration. Such recesses may overlap to achieve said affect. The target cups may be partially filled with a liquid of choice. Multiple launcher recesses can be used to provide a range of possible projectile shot angles at the target cup array. The recess pattern for the cup and launcher positions can be symmetrically disposed at each end of the board. The projectile balls can be attached to the game board by a tether, such as a string, wire, line (e.g., fishing line), thread, or other appropriate object, that prevents the balls from straying beyond the playing area while not significantly altering the balls' flight path.

This document also discloses the use of mechanical projectile systems, devices, and apparatuses, such as a spring-loaded launcher (e.g., a cylindrical peg for the base and a flat paddle for the lever). For example, a spring-loaded launcher can include a lever that is attached to the base via a pivoting rod, which provides a fulcrum by which a range of motion can be created. A compression spring can be positioned behind the fulcrum and underneath the bottom side of the lever. The projectile ball can be placed atop the lever in a cradle or other portion of the lever that holds the ball. By pressing down on and releasing the lever, the ball can be launched by the lever through the air toward the target cups. Alternatively, a tension spring may be attached at the forefront of the fulcrum moving the pivoting point to an opposite end of the lever. One or more mechanical projectile systems, such as the example spring-loaded launcher described above, can be used during game play. Other projectile systems, such as mechanical, electrical, and/or magnetic projectile systems, may additionally and/or alternatively be used.

The entire playing surface (e.g., game board) assembly may be stored as a single, foldable unit, which may or may not include targets such as cups. For example, a game board can be split along its shorter axis, and the two halves can be attached by hinges, enabling the top or bottom sides of the two halves to fold in on each other. Such a foldable game board may also contain recessed compartments that may be covered to allow the game components to reside within the game board when not in use. A latching mechanism may be employed to connect the end faces of the board to secure the folded unit. Further, a handle may be attached to the unit to allow for easy transportation.

In one implementation, a beer pong game includes a base with a playing surface that has (i) a first end with a first designated area for cups and (ii) a second end; a game piece; a tether that attaches the game piece to the base so as to permit the game piece to move freely within the tether's range; and a first launcher that includes a mechanism to launch the game piece as a projectile, the first launcher being positioned at or around the second end to launch the game piece toward the first designated area for cups, wherein the first designated area for cups and at least a portion of the first launcher are within the tether's range.

In another implementation, a game apparatus includes an elongated and planar game surface that defines one or more first recesses and one or more second recesses, wherein the first recesses and the second recesses are sized and shaped to each hold one or more arrangements of cups; a ball; a tether that connects the ball to the elongated and planar game surface; a first launcher that is located at a first end of the elongated and planar game surface, the first launcher including a first launching mechanism that is calibrated to, at least, launch the ball as a projectile toward the second recesses; and a second launcher that is located at a second end of the elongated and planar game surface, the second end being opposite the first end, the second launcher including a second launching mechanism that is calibrated to, at least, launch the ball as a projectile toward the first recesses.

The details of one or more implementations are depicted in the associated drawings and description thereof below. Certain implementations may provide one or more advantages. For example, the use of game pieces (e.g., balls) that are connected to playing surfaces by tethers (e.g., strings, cords, lines, chains, ropes) can help alleviate issues that arise from game pieces falling off of the playing surfaces during game play. For example, during a traditional beer pong game, ping pong balls that are thrown by players can, depending on the skill of the players, be thrown or otherwise ricochet off the table (example playing surface) during game play with a fair amount of frequency. When a ping pong ball leaves the table, game play slows down because players have to then locate and retrieve the ball. Additionally, balls that leave the table can get dirty from rolling around on the floor. Given that players often drink the contents of a cup filled with liquid after a ball has been thrown in the cup, this can pose a health risk to players. Players do attempt to clean balls after they have left the table, but such a cleaning step can additionally slow down game play and may be inadequate in eliminating the health risk. By using tethers, balls can be retained close to the playing surface and restricted from falling to the floor, which can increase the speed at which the game is played and can keep balls from becoming dirty, which can decrease the health risk to players.

In another example, the use of launchers to launch the game pieces as projectiles instead of relying on players to throw such game pieces by hand can ensure the fairness and consistency of game play. For instance, in traditional beer pong players may have to complete their throw without extending their hand over the playing surface. However, such a rule can be difficult to consistently enforce because players throw the ball from several feet above the table surface, which, depending on a player's vantage point, can make it hard to differentiate violations from legal throws. The disclosed technology can help to improve the fairness and consistency of game play by using launchers that are mounted to (or around) the playing surface, which can eliminate the guess work from whether a throw was legal or a violation. For instance, if a throw was made from a launcher that was located in one of the designated launcher mounting positions (e.g., recesses at the end of the game board), then the throw can readily be determined to have been a legal throw.

In a further example, the use of recesses in the playing surface (e.g., game board) to hold targets, such as cups which may be filled, at least partially, with liquid, can help to provide greater consistency in target location and alignment. For instance, in traditional beer pong, plastic cups are arranged on the surface of a table, which can lend itself to the cups inadvertently moving out of alignment, such as when cups are removed from their arrangement (e.g., cups removed as players successfully throw balls into the cups) and when the table is bumped by players or other people. The use of recesses for cups can allow the cups to be more securely positioned and retained in alignment for game play, regardless of whether the playing surface is flat or at an incline, or bumped by players or other users.

In another example, the combination of a smaller size for the disclosed game and its associated components (e.g., game piece, game board, cups) with launchers can allow for the disclosed game to be used in more locations with minimal impact on game play. For instance, traditional beer pong games have used larger playing surfaces, such as a ping pong table, that required a fairly large open space for game play. Such a space requirement can limit the venues and locations where beer pong games can be played. However, simply making a traditional beer pong game smaller may not be able to replicate the experience of traditional beer pong. For instance, with a smaller table the level of skill required to successfully throw a ball across the table and into a cup may be significantly less than the amount required with traditional beer pong. By using launchers with a beer pong game having a smaller size than a traditional beer pong game, the same or similar level of skill may be required of players of a traditional beer pong game but in a smaller setting (e.g., table-top game). Additionally (or alternatively), a game with a smaller size can be easier to transport, store, and use when compared with a traditional beer pong game.

In a further example, the use of magnets (or other similar quick release mechanisms) to attach tethers to the playing surface can allow for tethered game pieces to be used without risk of the tethers being accidentally broken. For example, magnets and other quick release mechanisms can be used that hold the tether and attached game piece (e.g., ball) to the game board and can be releasable such that a level of force applied to the tether will release the mechanism before breaking the tether.

In another example, the game board and/or game piece can include one or more light sources that can help improve game play, such in low light settings (e.g., night, dimly lit venue). For instance, recesses in the game board that are used to hold cups can include lights (e.g., light emitting diodes (LEDs)) that are embedded in/affixed to or around the recesses of the game board so as to illuminate target locations. In some implementations, electronic switches that are activated by the placement of cups within the recesses can be used to illuminate only the recesses in which a cup has been placed. As cups are removed during game play, such as when a player has successfully launched a game piece into a cup, the light illuminating the recesses of the cups that have been removed can be deactivated so as to highlight/illuminate only the remaining cups. Light sources can also be placed in the game pieces (e.g., balls) so that players can readily locate the game pieces, track their movement and trajectory, and follow the progress of the game.

In a further example, game boards can be configured to be adaptable and interchangeable so that more than two players or teams can participate in a game. In traditional beer pong, there are two ends of the playing surface which each have an arrangement of cups at which the player/team at the other end of the table is throwing game pieces. The disclosed game boards can include interchangeable parts that can permit a playing surface to be constructed that includes more than two ends with arrangements of cups. For instance, a game board can include multiple parts that can allow for the game board to be split and combined with other game boards so as to form any of a variety of shapes, such as an '+' shape that has four ends each having an arrangement of cups and a corresponding player/team. Such adaptability and combinability of the game boards and playing surfaces can allow for more varied play and can involve additional players and teams.

Other features, objects, and advantages of the technology described in this document will be apparent from the description, the drawings, and the claims.

BRIEF DESCRIPTION OF THE DRAWINGS

Like reference symbols in the various drawings indicate like elements.

DETAILED DESCRIPTION

Figure 1A:
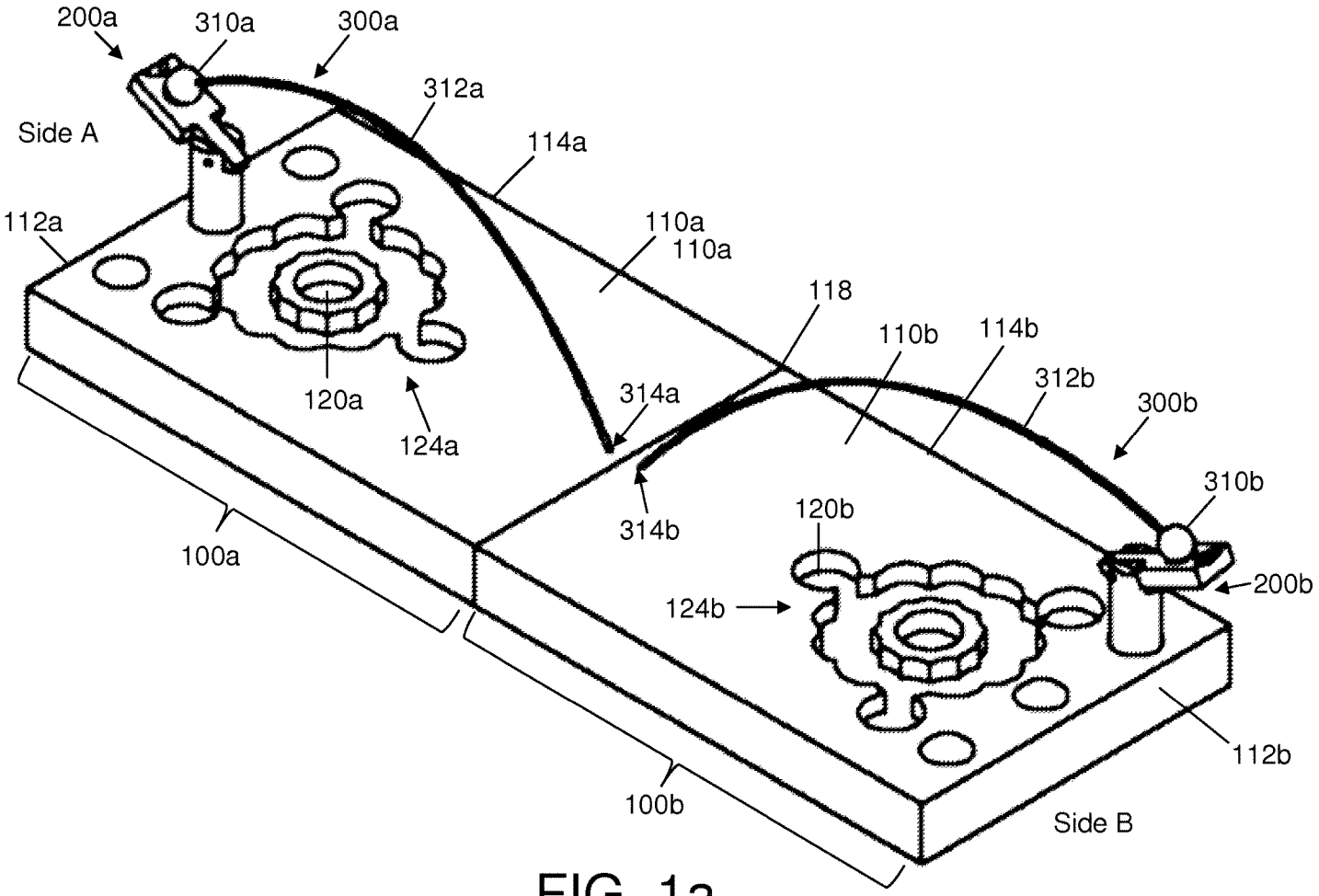
FIGS. 1A-B depicts a perspective view of an example game board with launchers and projectile subassemblies.

This document generally describes mechanical projectile and target games, associated components, and exemplary methods of play using the games. As described in greater detail below, such games can include mechanical launchers that launch game pieces, such as balls, as projectiles at target cups located on a playing surface. Game play can take any of a variety of forms, such as generally following game play rules commonly used in traditional beer pong games. Target cups can be filled with any of a variety of drinkable beverages, such as beer, liquor, soda pop, juice, and/or water, which can be consumed when a game piece has been successfully launched into a target cup.

As described in greater detail below, the disclosed target games can include a variety of features. For example, tethers (e.g., strings, cords, lines, cables, threads, chains, ropes, wires, strands) can be used to attach game pieces (e.g., balls, irregularly shaped objects, objects with custom designed shapes) to game boards and/or playing surfaces. Such tethers can be used to keep game pieces from straying too far away from the game board and/or playing surface, such as keeping game pieces from falling on the floor.

Tethers can be releasably attached to such game boards and/or playing surfaces, such as through the use of magnets and/or other releasable connectors. For example, a game board/playing surface can include one or more magnets that are embedded or otherwise affixed to the game board/playing surface, and a tether can be affixed to a magnet that is then magnetically coupled to the one or more magnets of the game board/playing surface. Such a magnetic coupling can allow for the tether to be released when a significant external force is applied to the tether without breaking the tether.

Instead of manually tossing game pieces by hand, launchers can be used to launch game pieces as projectiles at targets (e.g., cups) as part of game play. Launchers can include one or more of a variety of launching mechanisms, such as mechanical mechanisms, hydraulic mechanisms, electromechanical mechanisms, magnetic mechanisms, or any combination thereof. A variety of launchers can be used, such as catapult-like devices with launching arms that launch game pieces, slingshot-like devices with elastic regions that launch game pieces, peashooter-like devices that launch game pieces inserted into a tube of the device, contact-based devices that launch game pieces through contact of a member (e.g., bat, flipper, rod, paddle, stick, club) with the game pieces, and/or other appropriate launching mechanisms.

Launchers can be mounted or otherwise attached to game boards/playing surfaces. For example, launchers can be inserted into one or more recesses that are defined by the game board and/or playing surface. In another example, launchers can be moveably positioned along one or more tracks that are attached to or embedded within the game board and/or playing surface. Such movability of the launchers among a variety of locations on a game board and/or playing surface can allow a player to adjust the vantage point for each shot.

Game boards and/or playing surfaces can include designated areas for the placement of targets (e.g., cups). For example, game boards and/or playing surfaces can include a pattern of one or more recesses that are shaped and sized to hold cups. Such recesses can be in any of a variety of patterns. For instance, a plurality of distinct and non-overlapping recesses can be used to provide one or more patterns for the placement of cups, such as a triangle pattern, a diamond pattern, a circle pattern, or any other appropriate pattern. In another example, at least one recess can include overlapping locations where cups can be placed, such as a recess with cup locations offset and overlapping by a portion of a cup (e.g., offset by a quarter of a cup, offset by a third of a cup, offset by a half of a cup, offset by two-thirds of a cup, offset by three-quarters of a cup). Designated areas for the placement of cups can additionally and/or alternatively include raised areas for the placement of cups, such as pedestals, and/or raised edges encircling at least a portion of the location for the placement of each cup.

Game boards and/or playing surfaces can configurable so as to allow for two or more game boards/playing surfaces to be combined to permit more than two players/teams to play. For example, a game board/playing surface can include two separate halves (each half having an end where cups and launchers are located) that are releasably connected. Such halves can include one or more connectors that are configured to be combined with multiple other game board/playing surface halves so as to allow for a larger game board/playing surface to be constructed. For example, four halves can be combined in a x-like shape to permit four players/teams to participate in a game. In another example, six halve can be combined in a star-like shape to permit six players/teams to participate in a game.

Game boards and/or playing surfaces can be constructed of one or more appropriate materials. For instance, game boards/playing surfaces can be constructed of woods, plastics (e.g., injection molded plastics), inflatable bladders, polyethylene foams (e.g., buoyant material, such as the material used to make FUNOODLEs), or any combination thereof. For example, a floatable version of a game board/playing surface can include portions that are made out of inflatable bladders, such as the middle portion of the game board/playing surface, and portions that are made polyethylene form, such as the ends where cups and/or launchers are positioned.

Electronic components can also be incorporated into the game boards/playing surfaces, the game pieces, the launchers, and/or the designated areas for the cups. For example, light sources (e.g., LEDs, light-emitting electrochemical cells (LECs), organic LEDs (OLEDs), fluorescent light bulbs, incandescent light bulbs, laser diodes) can be affixed to and/or embedded within various components, such as recesses for cups, recesses for launchers, game pieces, graphics/logos located on the game board/playing surface, trims/edges of the game board/playing surface, and/or other appropriate locations. Light sources can be activated and deactivated automatically, such as through the use of switches or other sensors (e.g., switches/sensors that are located in the cup/launcher recesses). Any of a variety of appropriate power sources can be used to power electrical components, such as batteries that are incorporated into the game board/playing surface, photovoltaic cells, and/or external power sources (e.g., AC/DC power sources provided through an outlet).

The disclosed games can be produced in any of range of appropriate sizes and scales, such as a table-top size, a traditional beer pong game size, an industrial size (e.g., game board/playing surface can be the size of a tennis court), or any other appropriate size. Various additional features can be included based on the size of the game, such as a foldable table-top sized game board/playing surface that folds to create a carrying case for the game. In another example, a traditional beer pong game sized game board/playing surface can be collapsed and folded flat for transportation and storage.

In the drawings, which are described in greater detail below, distinct elements contain numerical labels. Like elements within the present disclosure may not contain redundant labels. Numerals containing "A" or "B" suffixes may indicate that a given element has a mirrored counterpart, oppositely disposed, such as Sides A and B at each end of the example game board 100.

This disclosure is not limited to the specific apparatuses, systems, devices, methods, conditions, components, and/or parameters that described and/or shown herein. The disclosed implementations and used terminology is exemplary and non-limiting.

As used herein, the term "beer pong" may include any drinking game associated with utilizing a playing surface, arrangements of cups thereon, and projectiles. Beer pong can also include other similar games, such as "Beirut," "Pong," "Ruit," "Lob Pong," "Toss Pong," and/or "Throw Pong." The term "traditional beer pong" can refer to beer pong using game components that include a larger playing surface (e.g., dimensions ranging from about 5 to 9 feet long by about 2 to 5 feet wide), larger target cups (e.g., cups ranging from about 10 to 16 fluid ounces with a large open end on top), and ping pong or table tennis balls (e.g., balls ranging from about 40-44 millimeters in diameter). Traditional beer pong play can include throwing, tossing, or bouncing the ping pong balls at or towards the target cups by hand.

As used herein, the term "cup" or the plural may include any sort of cup with an opening at one end that is capable of holding liquid, such as open frustoconical objects and/or open cylindrical objects that may be partially filled with liquid or particulate matter. A variety of cups can be used, such as shot glasses, shot cups, plastic cups, medicine cups, party cups, DIXIE cups, soufflé cups, chalices, and/or portion cups. Further, the term "target cup" can refer to those cups in play, the term "empty cup" can refer to those cups not in play, the term "rinse cup" can refer to any cup not in play and filled with a liquid used to clean the balls, and the term "sunken cup" can refer to a target cup that had a ball land in it during the course of a game and is to be removed from play either immediately or at the end of the turn.

As used herein, the term "tether" or the plural may refer to any relatively thin, elongated flexible material capable of connecting two points in space, such as strings, lines, ropes, cords, twine, series, chains, and/or threads.

As used herein, the term "game piece" or the plural may refer to any three dimensional object, solid or hollow, suitably sized such that it may be used as a projectile, such as balls/spheres (e.g., ping pong balls, table tennis balls, marbles), other regular shaped objects (e.g., cubes, boxes, cones), irregularly shaped objects, and/or custom shaped objects (e.g., three-dimensional logo, team mascot, figurine).

As used herein, the term "launcher" or the plural may refer to any device or mechanism capable of projecting a projectile through the air towards a target, such as catapults, shooters, projectors, launching pads, throwers, flickers, levers, and/or any other appropriate launching device/mechanism.

As used herein, the term "recess" or the plural may include any void that is defined, at least partially, by side walls and/or openings in an object, such a game board/playing surface. Such recesses may extend either partially or completely through an object and, as described in this document, can be designed to receive and hold cups, launchers, and/or other game components. Recesses can take any of a variety of appropriate shapes and forms, such as pockets, retainers, cutouts, holes, indentations, channels, apertures, holders, openings, and/or grooves.

As used herein, the term "racking" and/or "re-racking" can refer the process of arranging and/or rearranging the cups on the game surface prior to and/or during the progression of game play, respectively.

Figure 1B:
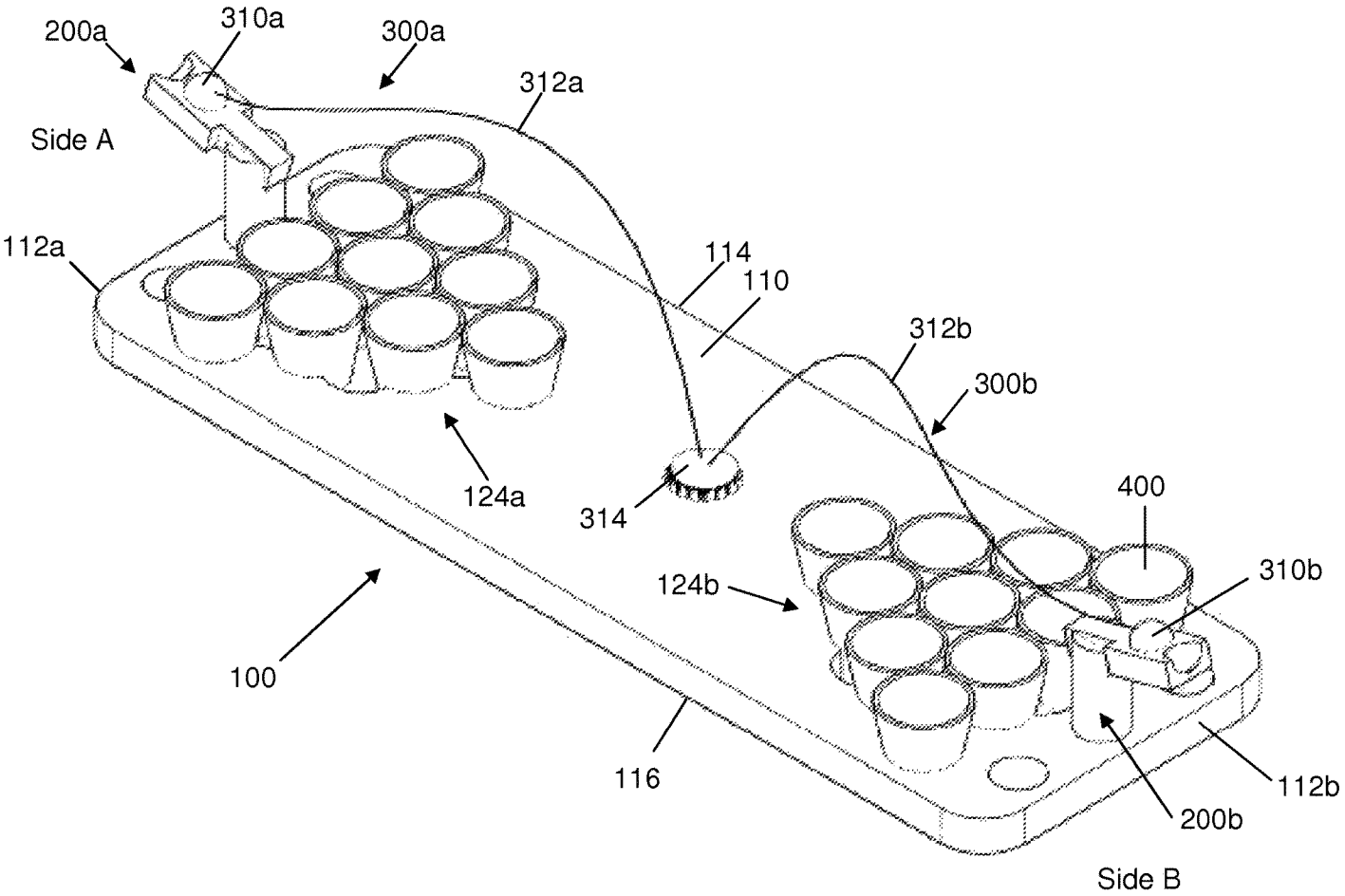

FIGS. 1A-B depicts a perspective view of an example game board 100 with launchers 200*a-b* and projectile subassemblies 300*a-b*. FIG. 1A depicts the game board 100 with recesses are empty and FIG. 1B depicts the game board 100 with the recesses holding arrangements of cups.

Referring to FIG. 1A, the example game board 100 is depicted as including an elongated playing surface 110 (e.g., planar surface, surface with one or more curves, surface with one or more uneven potions) with a first end 112*a* ("Side A") and second end 112*b* ("Side B") connected longitudinally (e.g., along a longitudinal axis 114). Any of a variety of dimensions and scales can be used to implement the game board 100. For example, the game board 100 can have a length of around twenty-six inches between ends 112*a* and 112*b* and a width of around nine inches along each of the ends 112*a-b*. Other dimensions, ratios, and/or scales may also be used.

The game board 100 includes a bottom surface 116 that is juxtaposed away from the top playing surface 110. The game board 100 can be designed to be placed upon a table or other sturdy surface (e.g., sturdy level surface) so that the bottom surface 116 engages the top surface of the table/other sturdy surface and rests parallel to it. Pads or other cushioning/gripping objects (not shown) that provide grip and clearance between the bottom surface 116 and the surface upon which the game board 100 rests can be affixed or otherwise attached to the bottom surface 116. Alternatively, the game board 100 may contain legs (not shown) that may be attached to the bottom surface 116. The legs may detach from the game board 100 and/or be foldable so as to allow for easy transportation and storage.

As depicted in FIG. 1A, the game board 100 can be made of two separate and substantially equal-sized portions 100*a* and 100*b*, which abut each other along a lateral axis 118 bisecting the game board 100. These portions 100*a-b* together can form the playing surface 110 and can be coupled to each other at the lateral axis 118 in a removable or non-removable manner. For example, the portions 110*a-b* can be connected to each other along the lateral axis 118 by hinge assemblies (not shown) so as to allow the game board 100 to fold in half for convenient transportation and storage. Other suitable methods for connecting the planar portions 110*a-b* may additionally and/or alternatively be used to achieve the same affect. Furthermore, additional portions (not shown) may be assembled in between portions 100*a* and 100*b* to further extend the game board 100 in any dimension (e.g., lateral expansion that includes additional portions (similar to the portions 110*a-b*) attached to the portions 100*a-b*, longitudinal expansion that includes additional portions increasing the distance between the portions 100*a-b*, vertical expansion that includes additional portions above and/or below the playing surface 110).

The components of the game depicted in FIGS. 1A-B (and other figures) may be decorated with artwork, colors, and other visual features to enhance the aesthetic appeal of the game. For example, decorations such as logos, insignia, and/or themed artwork may be engraved, painted, or printed to the game board 100 and its associated components, such as the launchers 200*a-b* and the game piece assemblies 300*a-b*.

Additional components may be included with the game board 100 to facilitate easy transportation and storage. Recesses (not shown) may be cut into the top surface 110 and/or bottom surface 116 of the board to store the launchers 200*a-b*. At least one carrying handle (not shown) may be fastened along the sides of the board 100 extending along longitudinal axis 114 and/or the ends 112*a-b*. Fastening mechanisms (not shown) may be employed with the foldable embodiment to secure its folded orientation. For example, one element of the fastening mechanism may be secured to end 112*a* and a second element to end 112*b*. When the game board 100 is folded, the two fastening elements may connect to lock the position of end 112*a* relative to end 112*b*. Other carrying components and fastening elements may additionally and/or alternatively be used.

The game board 100 may be constructed with a number of suitable materials. For example, the top surface 110 can be made of a hard material so as to allow the game pieces 310*a-b* to bounce at a reasonable height, such as wood, injection molded plastic, stone, and/or ceramics. The game board 100 can be coated with a liquid resistant outer layer to prevent damage and/or distortion. In some implementations, a foam or hollow interior for the game board 100 with a hard plastic or wood playing surface 110 can be used to allow the game board 100 to float in water. Alternatively, an inflatable game board 100 may be used instead to achieve the same affect. Other construction materials may additionally and/or alternatively be used to increase the versatility of the game board 100.

Example recesses 120-124, which are described in greater detail below with regard to FIG. 2, can be used to hold target cups (not depicted) and/or the launchers 200*a-b* are also depicted. Each of the ends 112*a-b* of the game board 100 can include the recesses 120-124 to hold respective target cups and launchers 200*a-b*.

The projectile subassemblies 300*a-b*, as also shown in FIGS. 1A-B, include example game pieces 310*a-b* (e.g., balls), example tethers 312*a-b* (e.g., strings), and example anchor pieces 314*a-b*. In the depicted example, two projectile subassemblies 300*a* and 300*b* are depicted. In some implementations, a single projectile subassembly can be used and shared by players/teams playing from each of the ends 112*a-b*. In some implementations, as depicted here, there may be one or more projectile subassemblies for each of the players/teams.

The tethers 312*a-b* connect the game pieces 310*a-b* to the anchor pieces 314*a-b*, which is attached (e.g., magnetically coupled, affixed) to the game board 100 and the playing surface 110. The game pieces 310*a-b* and tethers 312*a-b* may be attached to a single anchor piece or separate anchor pieces (e.g., pieces 314*a-b*). The game pieces 314*a-b* can be any of a variety of appropriate shapes, such as a solid sphere, which can be made of any durable material, such as wood, plastic, and/or metal, which may have a liquid resistant outer layer. Any suitable three dimensional shape may be used for the game pieces 310*a-b*.

The tethers 312*a-b* can be affixed to the game pieces 310*a-b* by any suitable means, such as wood glue, welds, and/or other appropriate fasteners. The tethers 312*a-b* can extend from the game pieces 310*a-b* to the anchor pieces 314*a-b*, which can be attached to the playing surface 110 or other portions of the game board 100. For example, the anchor pieces 314*a-b* can be fastened to the game board surface 110 and/or held in position by one or more magnets near the center of the game board surface 110, or be permanently or temporarily affixed to the surface 110 by some other mechanisms. Any hardware which can attach a tether, such as a string, to a planar surface, such as the playing surface 110, may be used as a suitable anchor piece. For instance, the anchor pieces 314*a-b* can be magnets attached to the underside of bottle caps or hallowed out binding posts spanning the depth of the game board 100. The tethers 312*a-b* can be made out of any thin, flexible material so as to allow for relatively uninhibited projectile motion. For example, the tethers 312*a-b* can be nylon string, jewelry cord, and/or fishing line. The tethers 312*a-b* can be waterproof to prevent erosion and target cup contamination. The tethers 312*a-b* can also be long and light enough so as to allow the game pieces 310*a-b* to freely move anywhere within the range of the tethers 312*a-b*, which may be defined by the lengths of the tethers 312*a-b* and the location at which the anchor pieces 314*a-b* are attached to the game board 100. For example, the tethers 312*a-b* can be a material that will not affect any reasonable flight path of the game pieces 310*a-b* and/or prevent any elastic recoil caused by overshooting. The tethers 312*a-b* can have a length that permits free projectile motion from the launchers 200*a-b* to the designated target areas (e.g., recesses 120 and 124 for target cups) while still being short enough to keep the game pieces 310*a-b* in the immediate playing area (e.g., restricting the game pieces 310*a-b* from falling on the floor). Two game pieces 310*a-b*, two tethers 312*a-b*, and one anchor piece can be employed for the game board 100, but at least one of each may be needed for appropriate game play.

Referring to FIG. 1B, the game board 100 is depicted as including cups that have been placed example arrangements in the recesses 124*a* and 124*b*. For instance, in the depicted example the cups are arranged in a triangular/pyramid pattern with a decreasing number of cups in each row ranging from four in the back row to one in the front row of each arrangement. Other arrangements of cups in the recesses 124*a* and 124*b*, and other arrangements of the recesses are also possible, such as recesses that have different overlapping patterns and/or arrangements of recesses that do not have any overlapping recesses.

Game play using the game board 100 can proceed in a variety of ways. In one example, players/teams on either side/end of the game board 100 can take turns shooting one or more of the game pieces 310*a-b* at the cups positioned in the recesses 124*a-b* at the opposite end of the board 100. When the game pieces 310*a-b* are successfully shot into a cup at the opposite end of the board 100, that cup can be removed from the arrangement (with the contents of the cup possibly being consumed by the players/team playing from the opposite end of the board 100). Play can proceed until one of the players/teams has eliminated all of the target cups from the opposite side of the board 100.

For example, a player A playing from side A/end 112*a* can load the game piece 310*a* into the launcher 200*a*, adjust the lateral angle of trajectory by rotating/twisting the base of the launcher 200*a* relative to its mount, and then launch the game piece 310*a* at the cups in the recesses 124*b* by pulling down and releasing the launcher 200*a*'s arm. By varying the lateral angle of the launcher 200*a* and the depth at which the arm of the launcher 200*a* is pulled down/backward, the player A can shoot the game piece 310*a* at any of the cups in the recesses 124*b*. When the game piece 310*a* lands in one of the cups in the recesses 124*b*, player B playing from side B/end 112*b* can remove the cup from the arrangement. Player A may take shots at the cups in recesses 124*b* with one or both of the game pieces 310*a-b* with each turn. Once player A's turn has ended, player B can then shoot one or more of the game pieces 310*a-b* at the cups in recesses 124*a* and, for any successful shots that land in cups, the player A can remove those cups from the arrangement of cups in recesses 124*a*. Play can then proceed until either player A or player B have successfully eliminated all of the cups on the opposing end.

Referring to FIG. 1B, an example anchor piece 314 is depicted as anchoring both the tether 312*a* for game piece 310*a* and the tether 312*b* for game piece 310*b*. As described above, one or more anchor pieces 314 can be used. Any of a variety of objects can be adapted to be used as anchors, such as objects that are related to beverage consumption (e.g., bottle caps, corks, bottle openers, corkscrews) and/or objects that are related to a promotion (e.g., mascot, logo, token, sports equipment). Such adapting of objects for use as anchors can include affixing and/or embedding one or magnets to or within the objects. The example anchor piece 314 is depicted as being a bottle cap with a magnet affixed to the underside of the cap.

Figure 2:
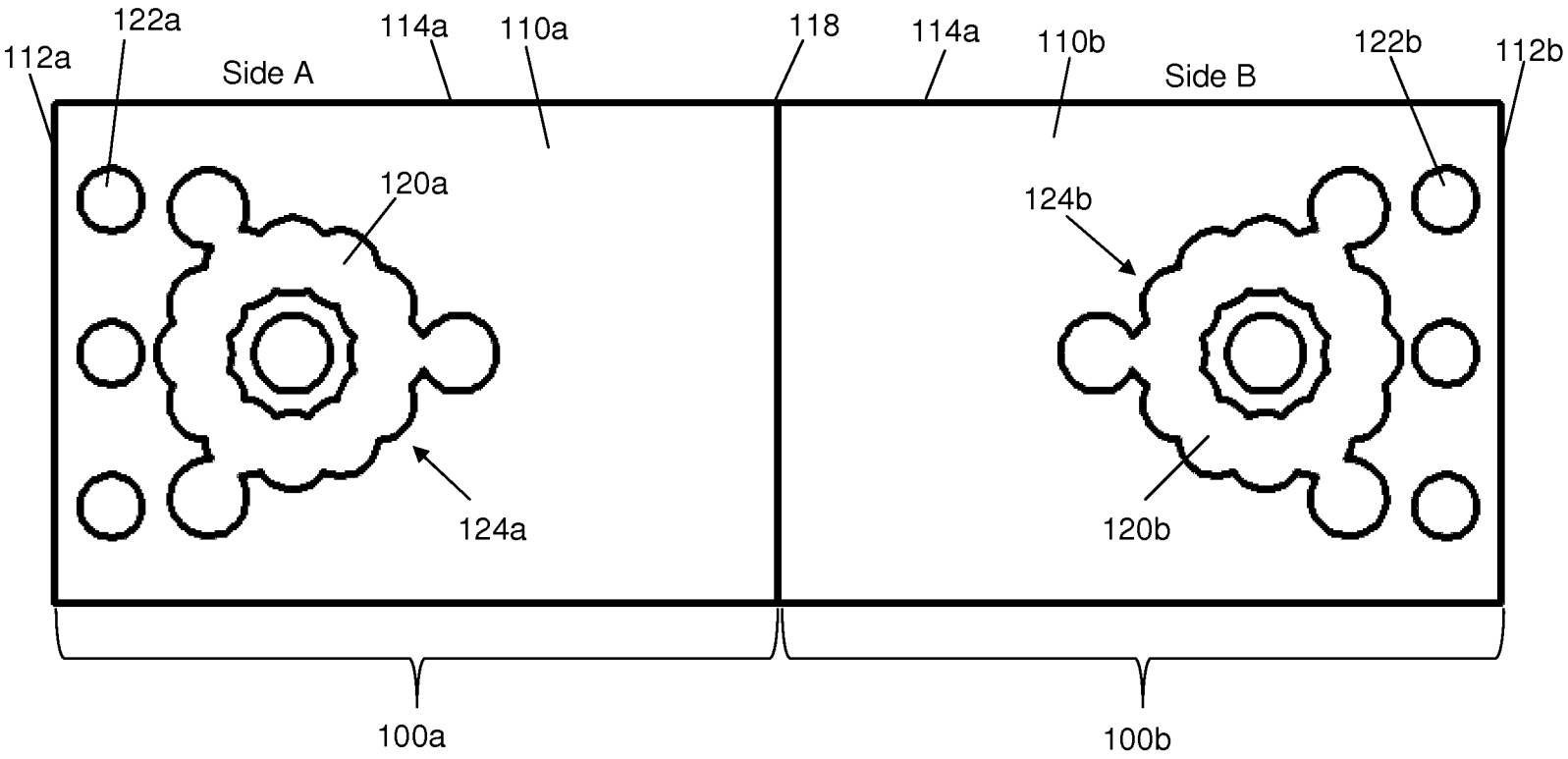
FIG. 2 depicts a top down view of the example playing surface of the game board, which includes a plurality of recesses therein.

FIG. 2 depicts a top down view of the example playing surface 110 of the game board 100, which includes a plurality of recesses therein. Example cup-receiving recesses 120*a-b* and launcher mounting recesses 122*a-b* are symmetrically disposed at both ends 112*a-b* of the game board 100. The launcher mounting recesses 122*a-b* are located in between the cup-receiving recesses 120*a-b* and each of the ends 112-*ab* of the game board 100. The launcher mounting recesses 122*a-b* are suitably sized to receive the base portion of the launchers 200*a-b*, such as the launcher peg 210, and are of a suitable depth to provide adequate stability for the launchers 200*a-b*. Multiple launcher mounting recesses 122*a-b* may be placed near each ends 112*a-b* of the game board 100 so as to provide multiple approach angles towards the target cups (not shown). For example, three launcher mounting recesses 122*a-b* are depicted in FIGS. 1 and 2 as being oppositely disposed at each end 112*a-b* of the game board 100. Other quantities of launcher mounting recesses 122*a-b* may additionally and/or alternatively be included in the game board 100. Additionally, although the recesses 122*a-b* are depicted as being in a linear configuration along the ends 112*a-b*, other configurations may also be used. For example, some of the launcher recesses 122*a-b* may be positioned further forward or backward from the respective ends 112*a-b*. In another example, launcher recesses 122*a-b* may be positioned along the sides of the playing surface 110 so that they are longitudinally aligned with or in front of the recesses 120*a-b*.

Each of the cup-receiving recesses 120*a-b* can extend below the playing surface 110 and can be suitably sized to receive the bottom of the target cups. The cup-receiving recesses 120*a-b* provide definite locations and stability (e.g., lateral stability) for each target cup. The recesses 120*a-b* can be spaced to allow the top rims of adjacent cups in the formation to be tangent to one another when racked or re-racked. The recesses 120*a-b* may overlap to achieve said effect. For instance, the specific target cup-receiving recess arrays 124*a-b* shown in FIG. 2 includes sixteen circular recesses 120*a-b*. Recess shapes other than circles may also be used. The example recess patterns 124*a-b* are depicted as containing one central recess, surrounded thereby twelve overlapping recesses which form a concentric circle around the central recess. The twelve recess circles are circumscribed by a triangle of three recesses, two forming a triangular base parallel to each of the ends 112*a-b*, and a third pointing towards the central axis 118. The radial nature of the cup receiving recess patterns 124*a-b* disclosed allows it to accommodate a range of cup sizes and arrangements. For example, cups of sizes one to three fluid ounces can be used.

Figure 3:
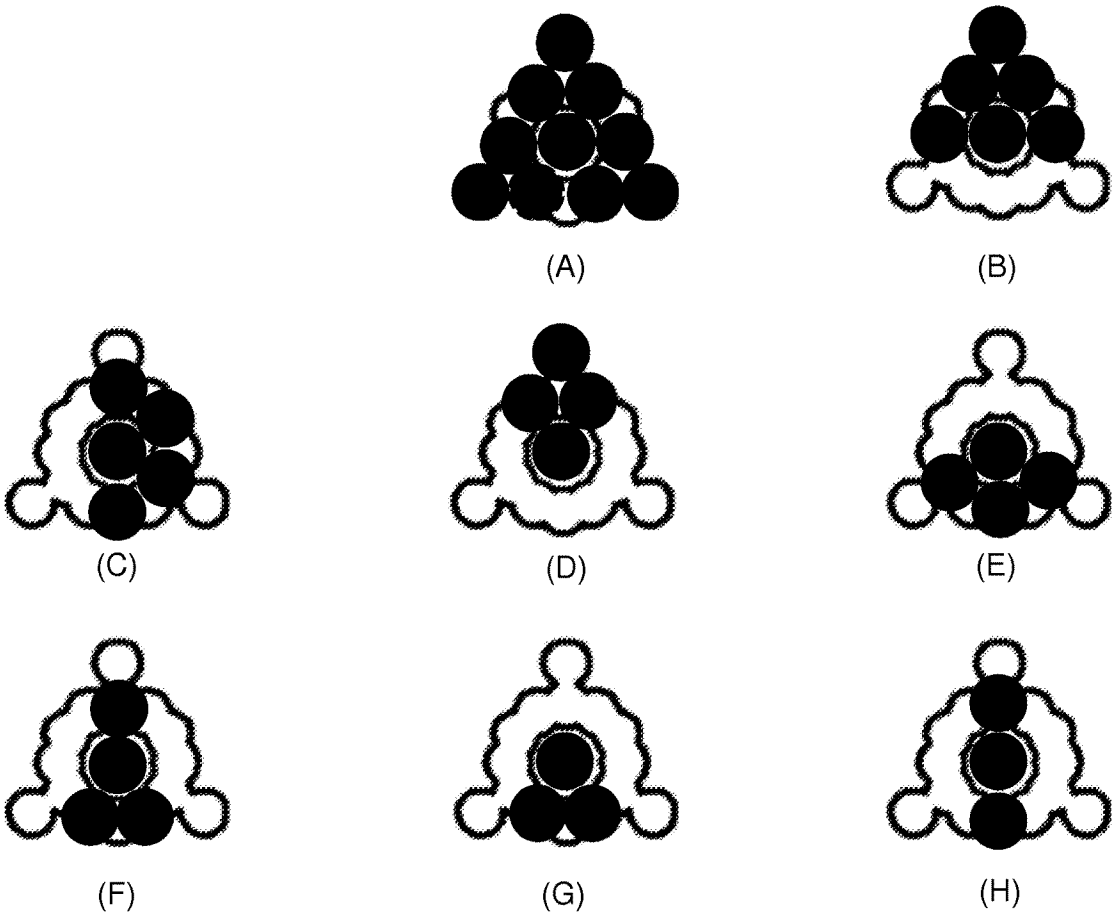
FIG. 3 depicts example racking arrangements using the depicted example recess pattern.

FIG. 3 depicts example racking arrangements using the depicted example recess pattern 124. For instance, the example cup-receiving recess array 124 disclosed allows for numerous racking and re-racking configurations, such as for a game that starts with set of 10 cups per side. In an initial 10 cup configuration (A), a 4-3-2-1 pyramid with the four cup base parallel to the ends 112*a-b* and the single cup pointing towards the central axis 118 is depicted. The design allows for racking and re-racking configurations including, for example, a six cup pyramid (B), a zipper (column of three adjacent to a column two) (C), a four cup diamond (short (D) and long (E)), a three cup triangle (F), and three in a line (G). Other racking and re-racking configurations may be used with the example cup-receiving recess array 124.

Figure 4D:
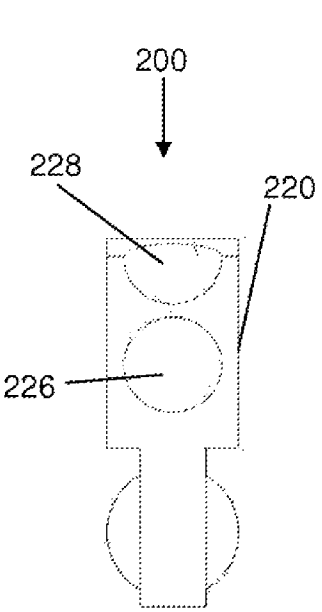
FIGS. 4A-D depict views of an example launcher.
Figure 4C:
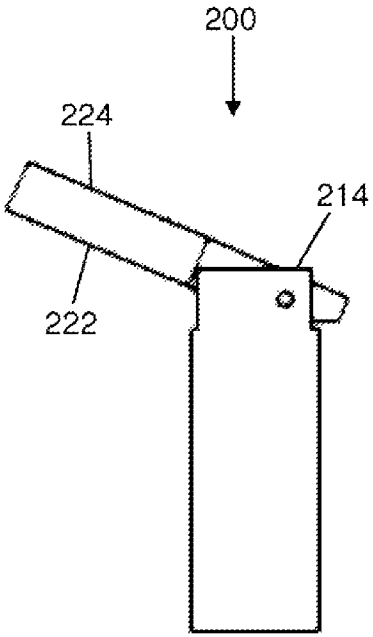
Figure 4B:
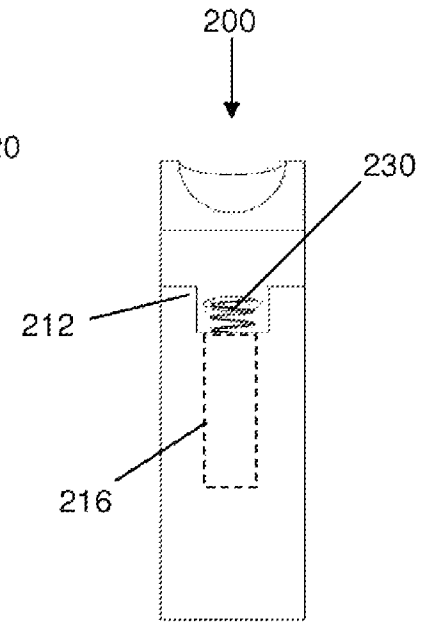
Figure 4A:
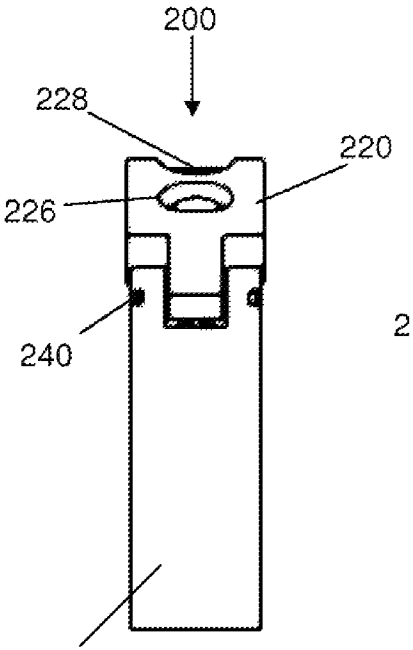

FIGS. 4A-D depict views of an example launcher 200. FIG. 4A depicts a front view of the example launcher 200. FIG. 4B depicts a rear view of the example launcher 200. FIG. 4C depicts a side view of the example launcher 200. FIG. 4D depicts a top down/overhead view of the example launcher 200. The example mechanical launcher 200 includes two main components: a base peg 210 and a lever 220 (e.g., launching arm), interfaced by a compression spring 230 and a pivoting element 240. The first component, the base cylinder or peg 210, provides the foundation for the launcher 200. The base peg 210 can be sized and shaped to securably fit into a launcher mounting recesses 122*a-b*. A slot 212 extends down from the top surface 214, spanning the entire diameter of the base peg 210 from front to back. This slot 212 enables the installation of the second component, the launching lever 220, which is inserted into the slot 212 and connected to the base peg 210 via a cylindrical rod 240. This rod 240 provides the pivot point or fulcrum for the lever 220 and is, in the depicted example, off-center from the base peg 210. The connecting rod 240 may consist of any of a variety of appropriate materials, such as a wooden, metal, or plastic dowel, or a nut and bolt combination. A variety of other connecting mechanisms may additionally and/or alternatively be employed to achieve the same affect.

A hole 216 (e.g., cylindrical hole) is extends axially into the peg from the slot 212, offset from the base peg centerline in the opposite direction of the connecting rod 240. This hole 216 provides a housing for a compression spring 230 that rests against the underside 222 of the lever 220. When the lever 220 is loaded or pressed down, the spring 230 compresses and stores potential energy. When released, the stored energy in the compressed spring 230 provides mechanical projectile launching force to launch the game piece 310*a-b* through the air as a projectile. Additionally and/or alternatively, a similar mechanism employing a tension spring may be used. Offsetting the spring 230 from the pivot point 240 increases the moment arm and thus mechanical advantage of the launcher 200. The lever top surface 224 can contain a circular indentation 226 to position and balance the game pieces 310*a-b* as well as a semicircular groove 228 for the player to grip/hold.

Alternatively, the launcher lever 222 may consist of a solid, possibly bent, spring steel, which can be mounted to or inserted into the base 210 or the game board 100 directly. Two to four launchers 200 may employed per game board, but at least one may be needed for appropriate game play.

There are a number of suitable materials that may be used in the construction of the launcher 200. For example, the launcher peg 210 and lever 220 may be made of various types of wood, molded plastic, metal, or any combination thereof. Such a wood should be coated with a varnish to protect the material from expanding when wet and to render it easy to clean. Any strong, water-proof material may be used instead.

Figure 5A:
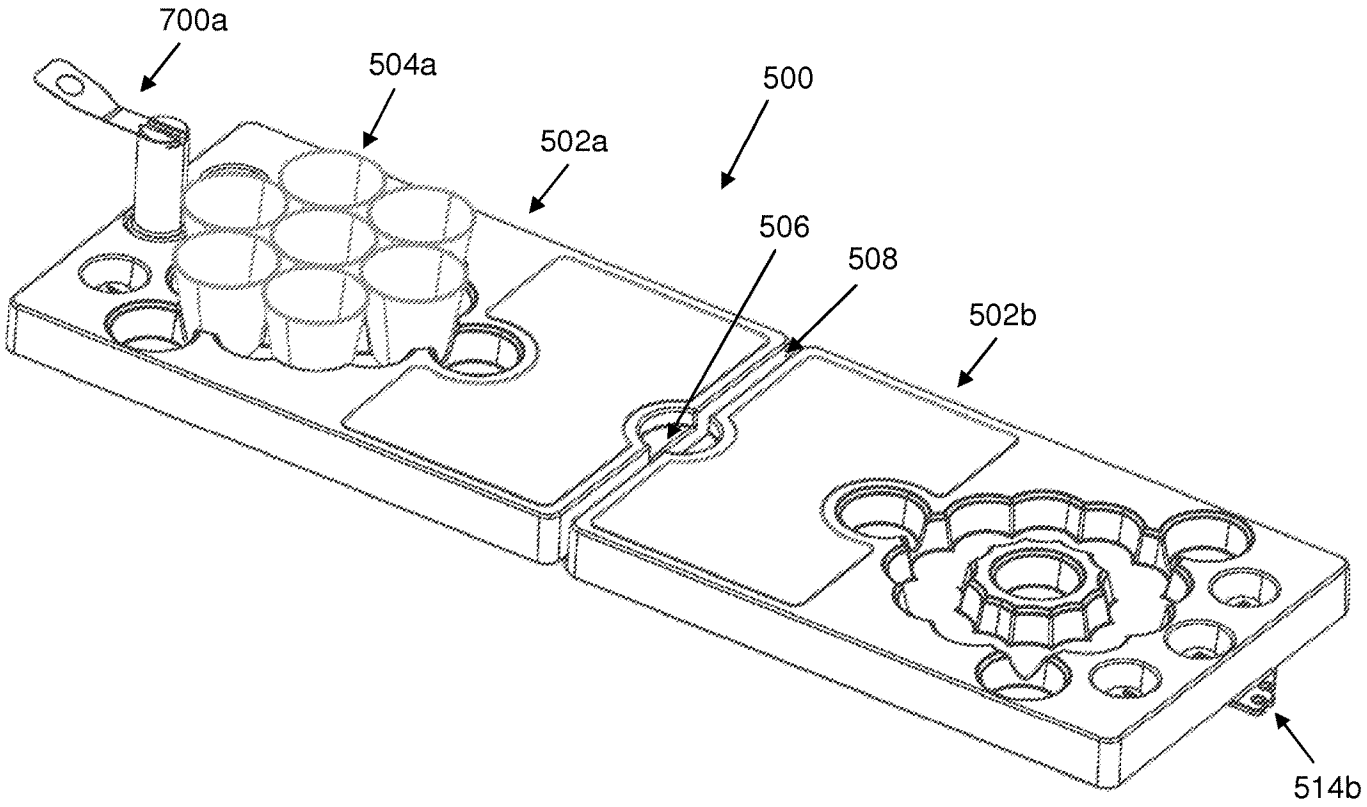
FIGS. 5A-F depict views of an example foldable game board.
Figure 5B:
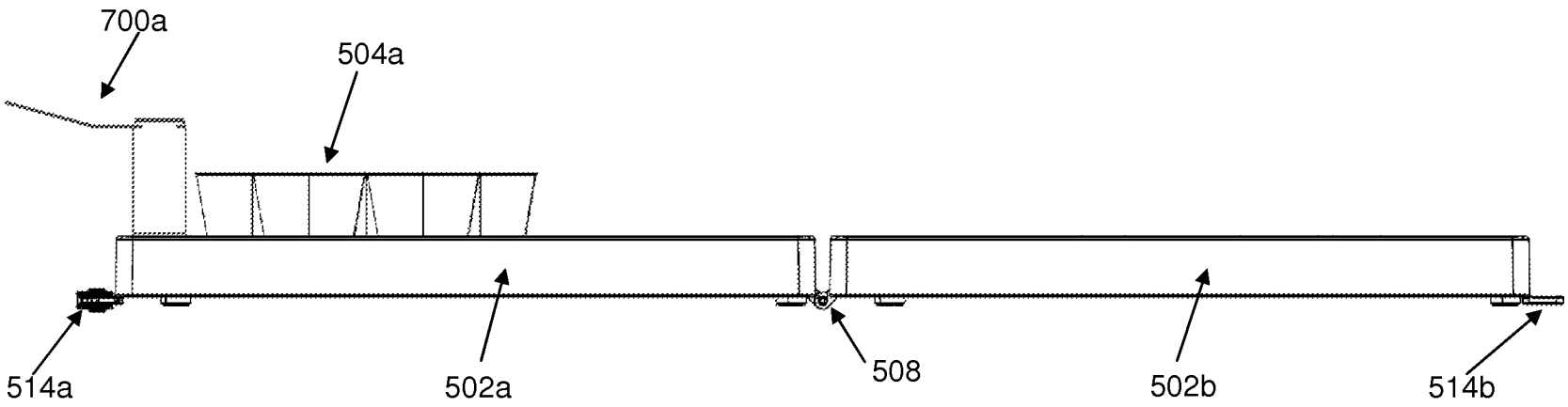
Figure 5C:
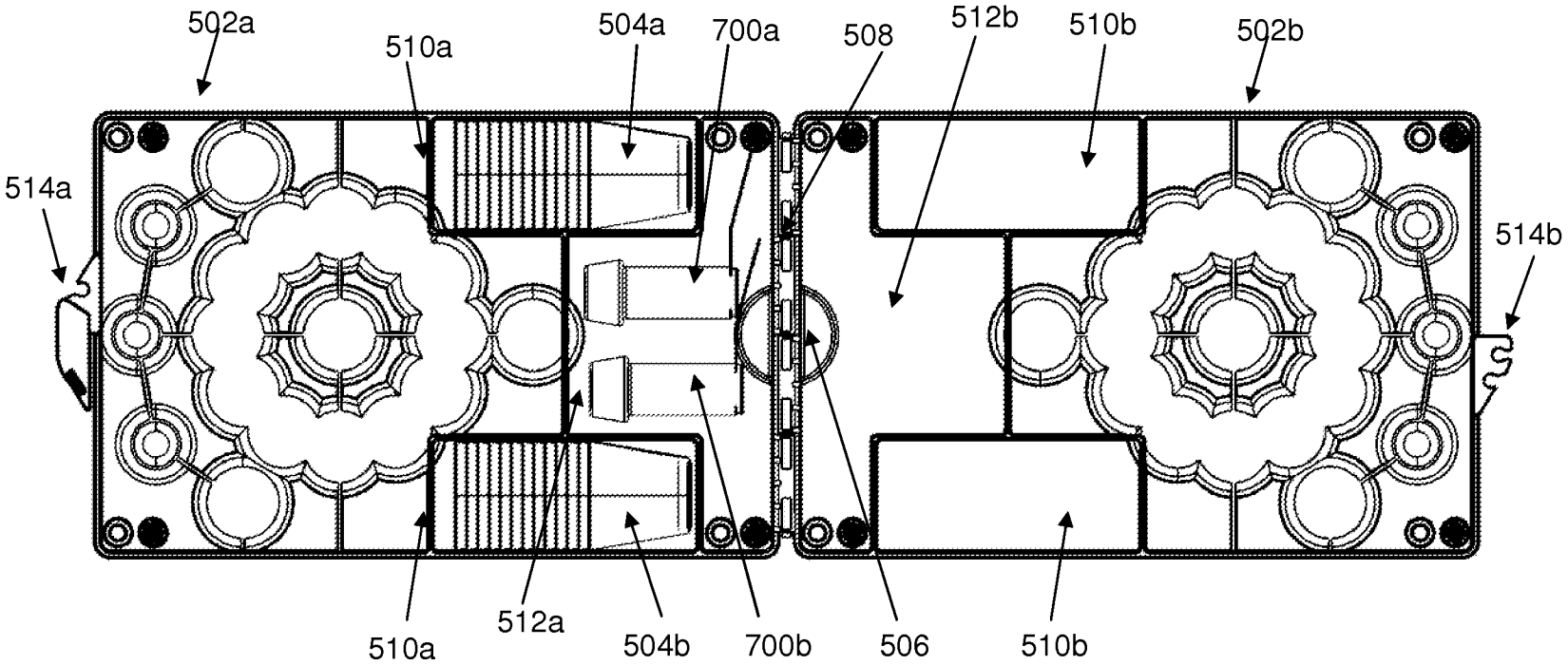
Figure 5D:
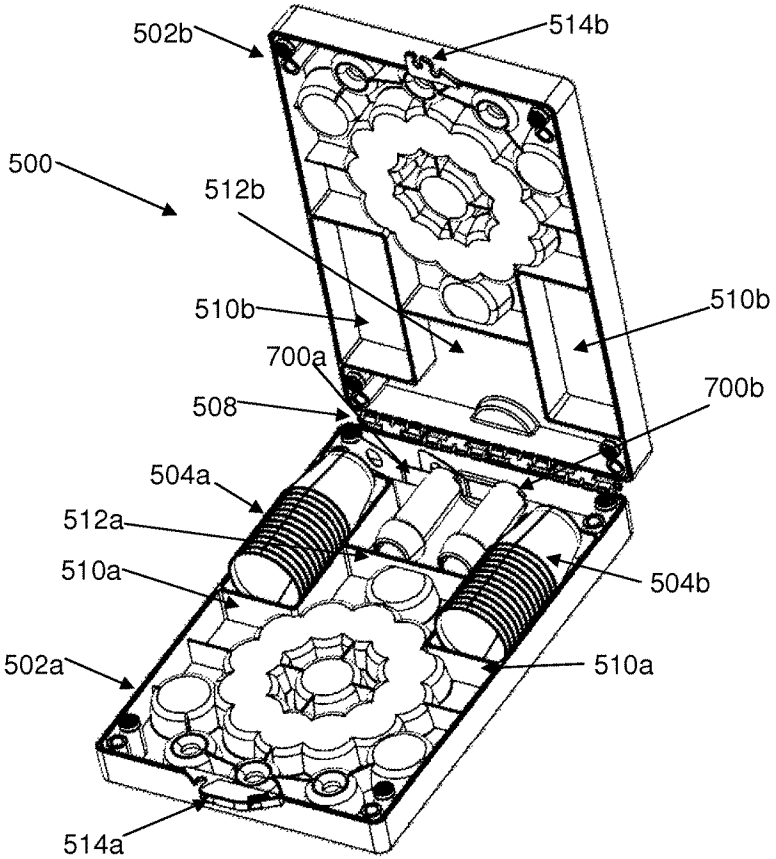
Figure 5E:
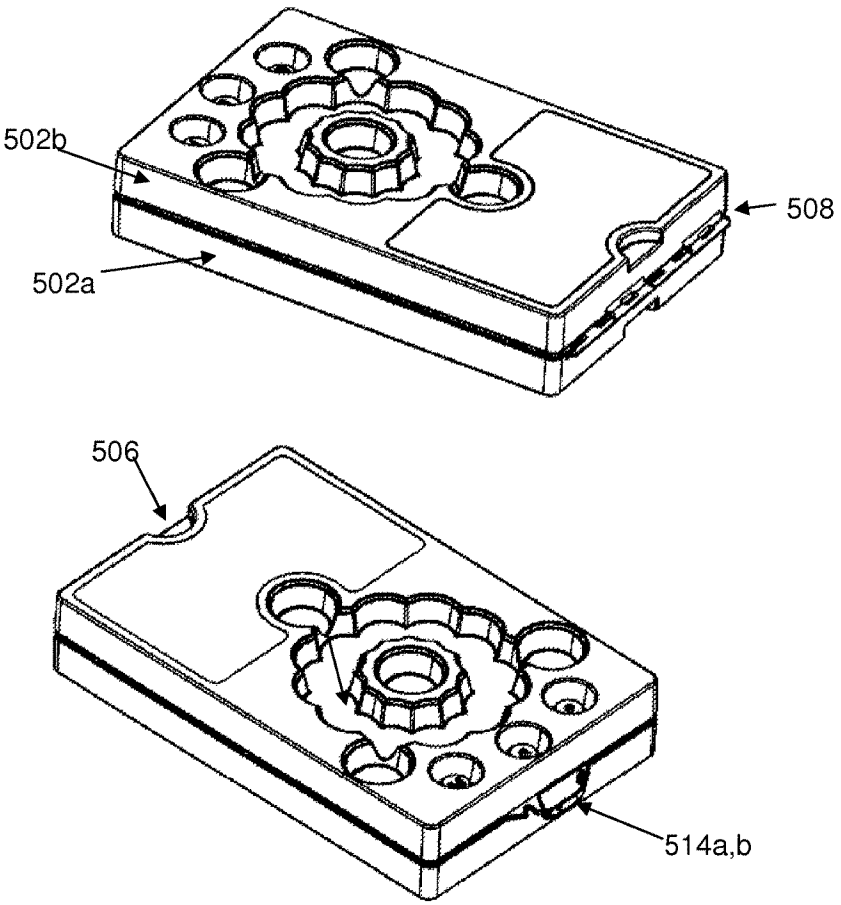
Figure 5F:
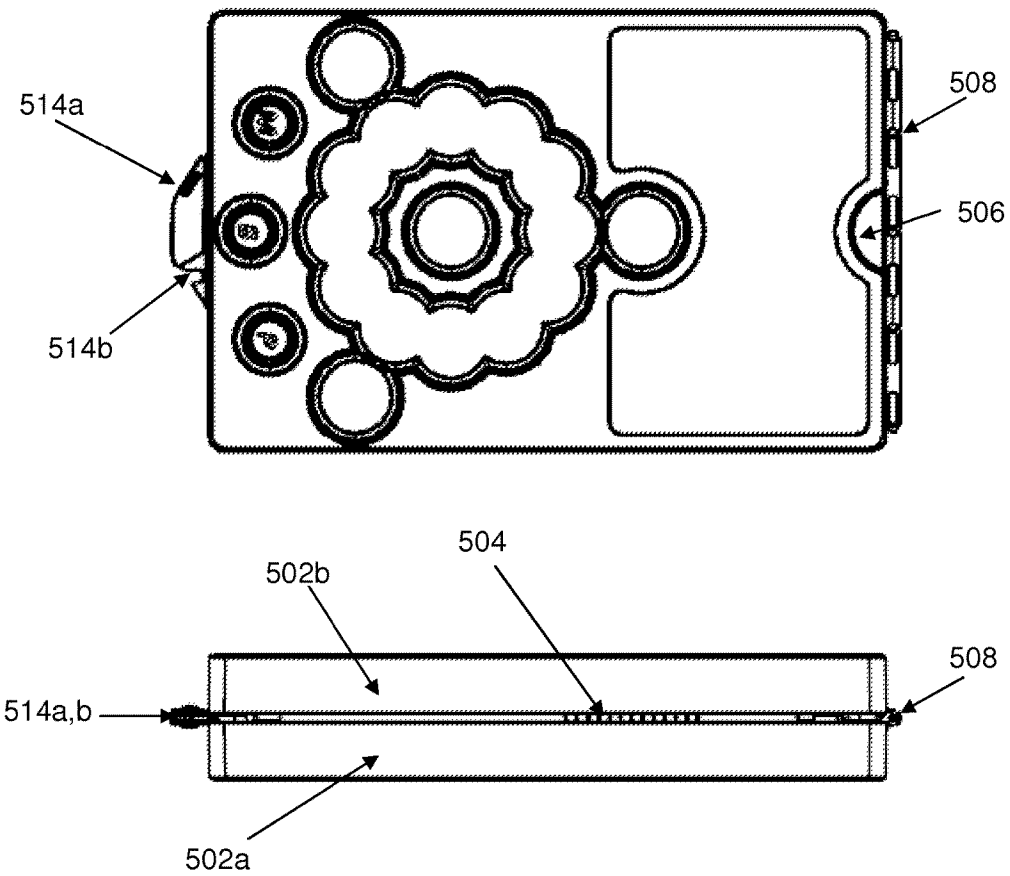

FIGS. 5A-F depict views of an example foldable game board 500. FIG. 5A depicts a perspective view of a top playing surface of the game board 500 when the board 500 is unfolded. FIG. 5B depicts a side view of the game board 500 when it is unfolded. FIG. 5C depicts a bottom view of a bottom/interior surface the game board 500 when the board 500 is unfolded. FIG. 5D depicts a perspective view of a bottom/interior surface of the game board 500 when it is partially folded. FIG. 5E depicts perspective views of the game board 500 when the board 500 is folded. FIG. 5F depicts a top down and a side view of the game board 500 when the board 500 is folded.

The game board 500 can be similar to the game board 100 described above. For example, the game board 500 includes a top playing surface with two portions 502*a-b* that each define patterns of recesses that are sized and shaped to hold target cups 504. The two portions 502*a-b* of the board 500 also include recesses that are sized and shaped to hold any of a variety of launchers, such as the example launchers 200 and/or the example launcher 700*a* (described below in greater detail with regard to FIG. 7). The recesses can hold any of a variety of arrangements of target cups, such as the example circular arrangement of cups 504*a* that is depicted in the recesses in portion 502*a*.

The game board 500 is designed to be folded (e.g., folded in half, folded in thirds, folded asymmetrically) along one or more hinged joints, such as at the hinge 508. In the depicted example, the hinge 508 is positioned between and joins the portions 502*a-b*, which are substantially equal in size and the board 500 can be folded in half. Other configurations of the hinge 508 (including one or more additional hinged joints) and/or other sizing of the portions 502*a-b* (including one or more additional portions) may also be used.

The game board 500 also includes a recess 506 that is defined by the portions 502*a-b* and that can serve to retain an anchor piece for tethers that are attached to the game pieces. The recess 506 may retain the anchor piece using one or more of a variety of mechanisms, such as physical engagement with one or more portions of the anchor piece that causes the anchor piece to be retained within the recess 506 and/or magnetic engagement with one or more magnets that are part of and/or proximate to the recess 506. For example, the recess 506 can be configured to be narrower at its opening at the playing surface and wider at its base. An anchor piece that is wider than the opening of the recess 506 yet still fits within the base portion of the recess 506 can then be positioned within the recess 506 (and retained by the narrower portion of the recess 506 at the opening) by being inserted into the wider/base portion of the recess 506 (and below the narrower opening of the recess 506) as the game board 500 is being unfolded. Such an anchor piece may be any of a variety of shapes, such as disc shapes, conical shapes, and/or conical frustum shapes (e.g. bottle caps).

The game board 500 can additionally include latching mechanisms 514*a-b* which are positioned at the ends of the board 500 and in locations so that they meet when the board 500 is folded along the axis defined by the hinge 508. Any of a variety of appropriate latching mechanisms can be used, such as spring latches, slam latches, cam locks, Norfolk latches, Suffolk latches, hooks, rotary latches, draw latches, compression latches, or any combination thereof.

Referring to FIG. 5C, the bottom/underside of the board 500 can include multiple different storage recesses and/or cavities that are defined in the bottom of the board 500 for storage of components that are used with the board 500, such as launchers (e.g., launchers 200, launchers 700), cups 504*a-b*, game pieces, tethers, and/or anchor pieces for the tethers. The storage of some components inside of the folded board 500 may be accomplished through recesses/cavities on the bottom side of both portions 502*a-b* of the board 500. In contrast, the storage of some components inside the folded board 500 may be accomplished through recesses/cavities on only one of the two portions 502*a-b* of the board 500.

Example storage of the cups 504*a-b* is depicted through the use of recesses 510*a* defined in the bottom side of the portion 502*a* of the board 500 and recesses 510*b* defined in the bottom side of the portion 502*b* of the board 500. The recesses 510*a-b* together can provide a storage location within the folded board 500 for the cups 504*a-b*. The recesses 510*a-b* can mirror each other along the axis defined by the hinge 508.

Similarly, example storage of the launchers 700*a-b* is depicted through the use of recess 512*a* defined in the bottom side of the portion 502*a* of the board 500 and recess 512*b* defined in the bottom side of the portion 502*b* of the board 500. The recesses 512*a-b* together can provide an internal storage location for the launchers 700*a-b* within the board 500 when folded in half along the axis of the hinge 508. The recesses 512*a-b* can mirror each other along such an axis to provide for a storage cavity with a height/depth that is greater than the individual depth of each of the portions 502*a-b*.

The storage cavities in the bottom side of the board 500 can be positioned so as to not interfere with the recesses for cups, launchers, and/or anchor pieces on the opposite, playing side of the game board 500. As illustrated in the depicted example, the storage recesses 510*a-b* and 512*a-b* are positioned near the central portion of the board 500 (as opposed to the ends of the board 500 near the launchers) so as to avoid the recesses for the cups and launchers.

The board 500 can be made out of any of a variety of appropriate materials, such as woods, plastics (e.g., injection molded plastics), metals, 3D-printable materials, or any combination thereof. For example, the board 500 can be made out of an injection molded plastic, as indicated by the underside of the playing surface recesses (e.g., cup recesses, launcher recesses) being defined in the bottom surface of the board 500. In some implementations, such definition of the playing surface recesses in the bottom side of the board 500 will not be present, such as with wooden game boards 500 where the recesses (playing surface recesses and storage recesses) are carved/milled out of a solid piece (or pieces) of wood.

The underside of the board 500 also includes risers (e.g., pads, feet, cork, rubber pads), which are indicated in FIGS. 5C-D by the black circles in the corners of the portions 502*a-b* of the board 500. The risers can provide for separation between the game board 500 and a surface upon which the game board 500 is resting (e.g., table, bar). The risers can also provide for cushioning between the two portions 502*a-b* when they are folded on each other, for example, so that they do not damage each other. Such spacing between the portions 502*a-b* when folded is depicted in the side view in FIG. 5F.

Although not depicted, in some implementations the board 500 may additionally and/or alternatively be folded in an opposite direction so that the top playing surfaces fold in on each other, instead of the bottom surfaces folding in on each other (as depicted in FIGS. 5D-F.

Figure 6A:
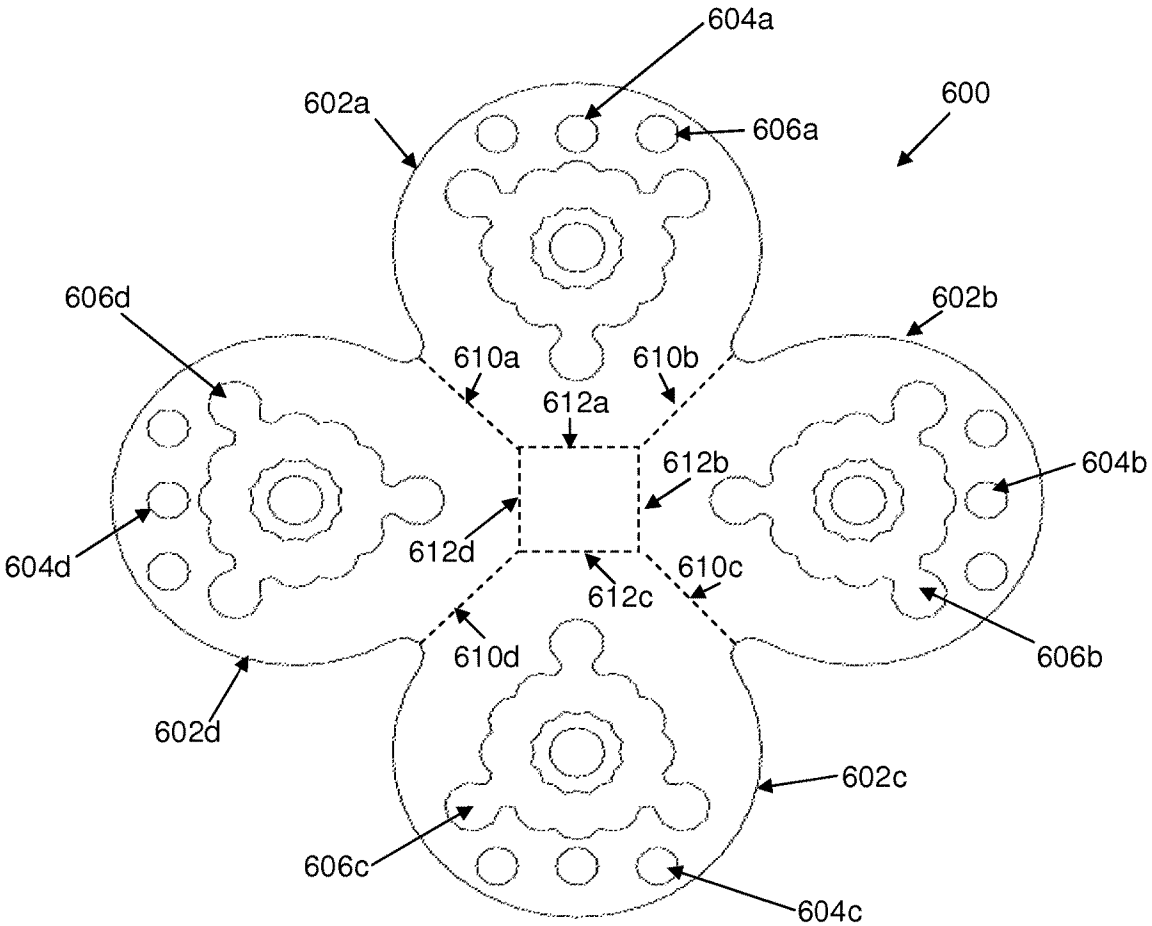
FIGS. 6A-B depict overhead views example game boards with playing surfaces that include four target ends.
Figure 6B:
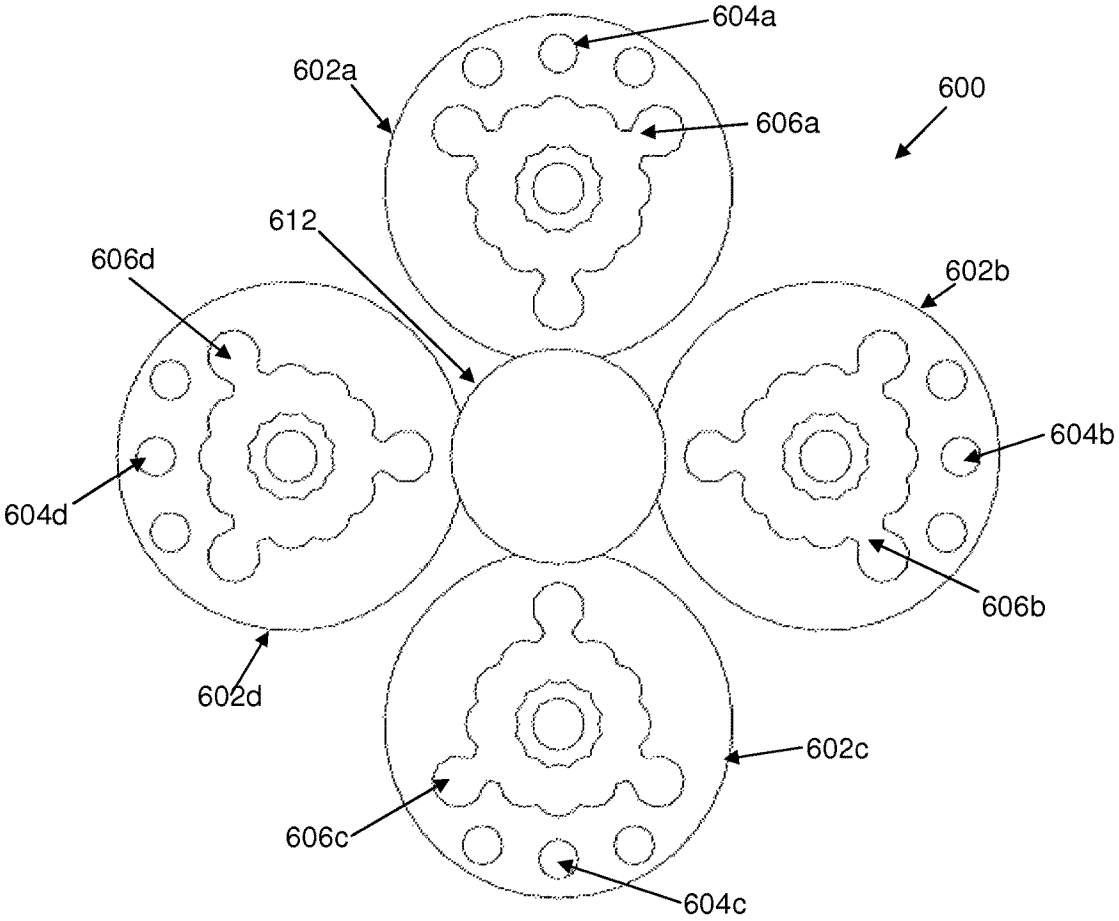

FIGS. 6A-B depict overhead views example game boards 600 with playing surfaces that include four target ends 602*a-d*. FIG. 6A depicts a first example configuration of the target ends 602*a-d* in which the target ends 602*a-d* and FIG. 6B depicts a second example configuration of the target ends 602*a-d*. Other configurations are also possible. With both example configurations of the game board 600, the ends 602*a-d* can each include mounts 604*a-d* for launchers and designated areas 606*a-d* for the placement of target cups.

As described above, the mounts 604*a-d* can be any of a variety of structures into which the launchers can be inserted and/or to which the launchers can be attached to provide stability for the launchers along one or more dimensions (e.g., lateral stability, longitudinal stability). For example, the mounts 604*a-d* can be recesses that are defined in the playing surface of each of the ends 602*a-d* into which the launchers can be inserted, and that have a sufficient depth so as to provide longitudinal and lateral stability so that the launchers do not fall over or out of the recesses when being used to launch game pieces at the designated areas 606*a-d* at the other target ends.

As described above, the designated areas 606*a-d* can include any of a variety of structures that can be used to define, direct, and/or secure the placement of target cups within one or more arrangements. For example, the designated areas 606*a-d* can be recesses that are defined by openings that extend from the playing surfaces and into the internal space of the ends 602*a-d*.

Referring to FIG. 6A, the target ends 602*a-d* may all be part of the same piece or they may be separate pieces that are adjoined at, for example, at edges/faces that are indicated by lines 610*a-d*. For instance, the target end 602*a* may be attached to the adjacent target ends 602*b* and 602*d* by edges/faces that meet, for example, at lines 610*b* and 610*a*, respectively. The target ends 602*a-d* may also include front ends/faces 612*a-d* that, in the depicted example configuration with four target ends, are either not adjoined to another end or which are each adjoined to a common center piece. The ends 602*a-d* may be adjoined using any of a variety of mechanisms, such as hinges, tongue and grooves, and/or other appropriate mechanisms. The ends 602*a-d* may be detachable from each other, or may otherwise be individually capable of being withdrawn from the playing surface (e.g., folded underneath one or more of the other ends by a hinged joint). For example, the ends 602*b* and 602*d* may be removed from the playing surface, and the ends 602*a* and 602*c* may be adjoined to each other at the ends/faces 612*a* and 612*c* being attached to each other, so as to create a playing surface for two players/teams.

Referring to FIG. 6B, the target ends 602*a-d* can be attached to each other through an attachment mechanism 608, to which each of the target ends 602*a-d* may attached. The attachment mechanism 608 may have any of a variety of configurations that are capable of rigidly securing and orienting the target ends 602*a-d* into one or more alignments, such as an 'X' configuration as depicted in FIG. 6. For example, the attachment mechanism 608 can be a solid piece of material, a frame, or any combination thereof. The attachment mechanism 608 can include one or more attaching and orienting mechanisms that are capable of mating with opposing attaching/orienting mechanisms on each of the target ends 602*a-d*. For example, the attachment mechanism 608 can include four sets of pegs that mate with appropriately sized and spaced sets of holes in the playing surface of each of the target ends 602*a-d*. The attachment mechanism 608 may be expandable in size, so as accommodate additional target ends 602*a-d* beyond the four target ends 602*a-d* that are depicted. For example, if the attachment mechanism 608 were a larger size similar to the size of the target ends 602*a-d*, the attachment mechanism 608 may be able to accommodate two or four more target ends within the arrangement. The attachment mechanism 608 may also be used with fewer than four target ends, such as with two or three target ends.

Figures 7A, 7B, 7C, 7D:
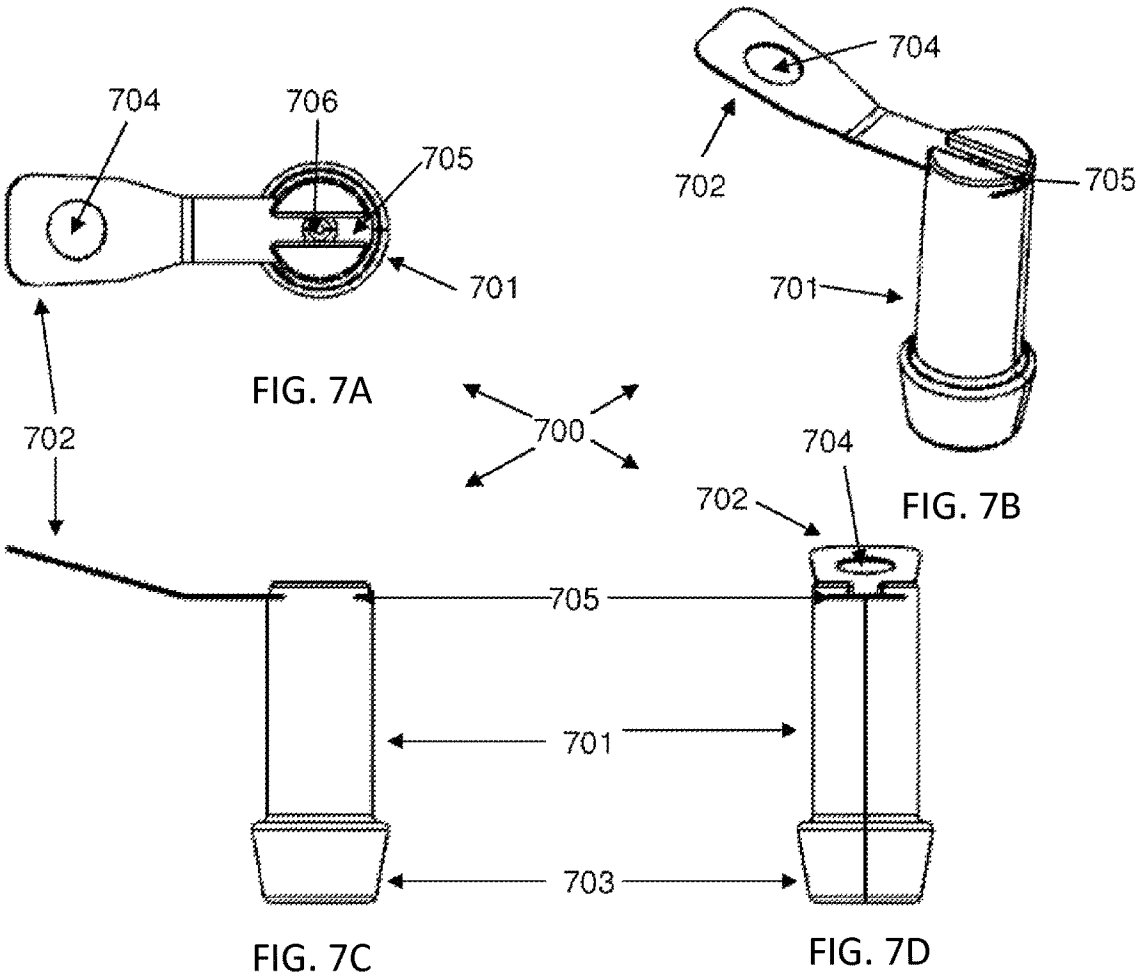
FIGS. 7A-D depict views of an example launcher.

FIGS. 7A-D depict views of an example launcher 700. FIG. 7A depicts a top down/overhead view of the launcher 700. FIG. 7B depicts a perspective view of the launcher 700. FIG. 7C depicts a side view of the launcher 700. FIG. 7D depicts a front view of the launcher 700.

The launcher 700 is similar to the launcher 200 described above and uses a mechanical mechanism to launch game pieces at target cups. Also like the launcher 200, the launcher 700 is configured to be mounted to a game board for use, such as being inserted into recesses defined by the playing surface of a game board.

The launcher 700 includes a base peg 701 and a lever 702 (e.g., launching arm) that is secured to the top of the base peg 701. The base peg 701 includes a mounting portion 703 that is sized and shaped to be mounted to one or more appropriate mounting elements one a game board. For example, the mounting portion 703 can be sized and shaped to be inserted into one or more recesses that are defined in the playing surface of a game board. In another example, the mounting portion 703 may have a hollow and open interior that is sized and shaped to be securely placed on one or more protrusions (e.g., pegs) that extend from and/or are embedded within the playing surface of the game board.

A player can launch a game piece using the lever 702 by placing the game piece in a holder 704 (e.g., hole, indent, dimple) that is located near the end of the lever 702, bending the lever 702 backward, and releasing the lever 702. The lever 702 can be any of a variety of resilient materials that are capable of absorbing energy when deformed (e.g., bent backward) and releasing the energy upon being unloaded (e.g., released). For example, the lever 702 can be made out of a metal, rubber, plastic, wooden, composite, and/or other appropriate materials. For example, the lever 702 can be made out of a single piece of steel.

The lever 702 can be secured to or near the top of the base peg 701 in any of a variety of manners. For example, an end of the lever 702 is depicted as being inserted into a groove 705 that extends through the diameter of the base peg 701. The lever 702 is additionally secured into place by the use of the fastener 706, such as a screw, nail, rivet, or other appropriate fastener, that fastens the lever 702 to the base peg 701—keeping the lever 702 from sliding forward or backward out of the groove 705.

Figures 8A, 8B, 8C:
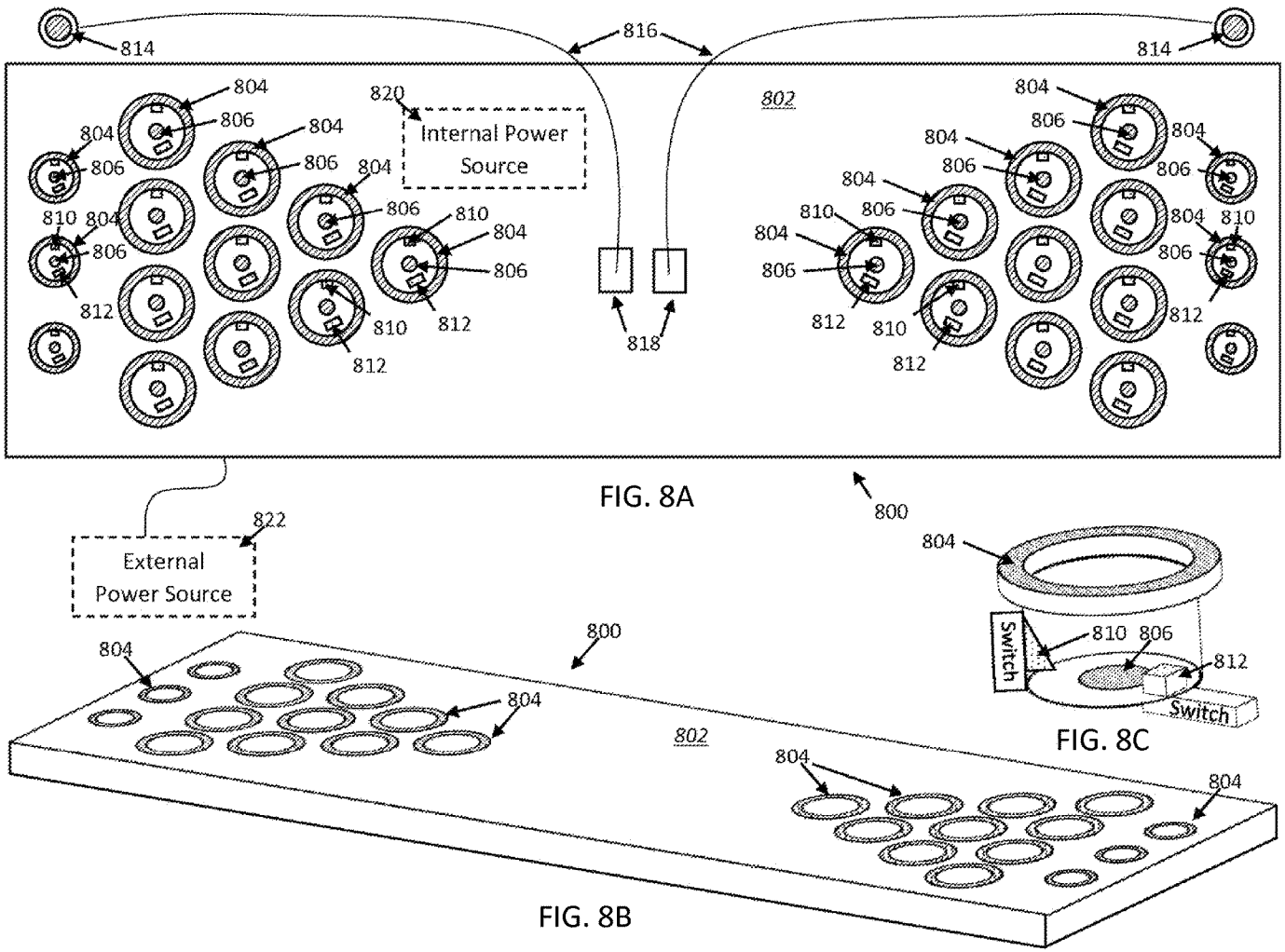
FIGS. 8A-C depict views of a game board that includes example light sources.

FIGS. 8A-C depict views of a game board 800 that includes example light sources. FIG. 8A depicts a top down/overhead view of the playing surface 802 of the game board 800. FIG. 8B depicts a perspective view of the game board 800. FIG. 8C depicts a perspective view of an example recess that includes light sources.

As described above, the disclosed game boards can additionally include one or more light sources that can be used to illuminate various elements of the game board and its associated components (e.g., cups, launchers, game pieces). In the examples depicted in FIGS. 8A-C, the cross-hatched regions are example locations where light sources can be located on an example game board 800. The dotted regions are example locations where switches and/or sensors may be located to detect the presence of game components, which can be used to selectively activate/deactivate the light sources.

A variety of light sources can be used. For example, light sources 804 that circumscribe recesses for the cups and/or launchers can be used. In another example, light sources 806 that are located within the recesses for the cups and/or launchers, such as on or within a bottom surface of the recesses, can additionally and/or alternatively be used. Switches and/or sensors 810 can be mounted to the sidewall of the recesses to detect the presence and/or absence of corresponding cups/launchers, which can be used to control one or more of the corresponding light sources. Switches and/or sensors 812 can additionally and/or alternatively be mounted to a base surface of the recesses to detect the presence and/or absence of corresponding cups/launchers, which can be used to control one or more of the corresponding light sources. One or both of the light sources 804 and 806 can be used, and one or both of the switches/sensors 810 and 812 can be used.

The game pieces can also include light sources 814, which may be embedded within, project out of, or otherwise affixed to the game pieces. The light sources 814 may have internal power sources and switches, or may be powered through electrical connections 816 running along the tether. The electrical connections 816 can be coupled to the board 800 through the use of anchors 818, which may be releasably connected to the board 800, such as through the use of magnets.

The light sources 804, 806, 814 can be powered by one or more internal power sources 820 (e.g., batteries, photovoltaic cells) and/or one or more external power sources 822 (e.g., wall outlet, external AC power source, external DC power source). The light sources 804, 806, 814 can include any of a variety of appropriate light emitting technologies, such as LEDs, LECs, OLEDs, fluorescent light bulbs, incandescent light bulbs, and/or laser diodes. The light sources 804, 806, 814 may be configurable to emit light any of a variety of different visible colors. Additionally, the light sources 804, 806, 814 may be combined with one or more additional components to enhance or otherwise alter the light that is emitted, such as being combined with diffusers and filters. The light sources 804, 806, 814, as well as all electrical connections and components, can be adapted to be water and moisture resistant.

The example game board 800 is depicted as including an arrangement of cup recesses that are distinct and non-overlapping. As described above, such a recesses can additionally and/or alternatively be used with the other example game boards described throughout this document. Additionally, the light sources and associated configurations that are described with regard to the game board 800 can also be used with other configurations of recesses, such as the overlapping cup recesses that are described with regard to some of the other example game boards in this document.

Although not depicted in the figures, the removable cup rack inserts may be used with any or all of the game boards described above. For example, a removable tray that is configured to overlay the cup recess patterns of one or more boards can be inserted into the recesses, can hold cups, and can be removed, for example, for easy cleanup of the recess/cup holder surfaces (e.g., wash in in sink or dishwasher).

Additionally, the cup recesses and rack configurations can scale to a range of cup sizes. For example, the cup recesses and their relative positioning can be increased in the boards to accommodate larger cups, or can be decreased to accommodate smaller cups. Alternatively, scaling may also be accomplished through the use of tray inserts that may adjust the size and shape of the recesses to fit differently sized cups than the recesses that are provided in the game board. In some implementations, the game board may include one large recess that is configured to hold removable trays, which can come in various sized recesses and recess arrangements to allow for quick and easy modification of the game board.

The above description provides examples of some implementations. Other implementations that are not explicitly described above are also possible, such as implementations based on modifications and/or variations of the features described above. For example, the techniques described above may be implemented in different orders, with the inclusion of one or more additional steps, and/or with the exclusion of one or more of the identified steps. Similarly, the systems, devices, and apparatuses may include one or more additional features, may exclude one or more of the identified features, and/or include the identified features combined in a different way than presented above. Features that are described as singular may be implemented as a plurality of such features. Likewise, features that are described as a plurality may be implemented as singular instances of such features. The drawings are intended to be illustrative and may not precisely depict some implementations. Variations in sizing, placement, shapes, angles, and/or the positioning of features relative to each other are possible. Those skilled in the trade will appreciate that many changes or modifications may be made to implementations shown and described in the present disclosure without departing from the board scope thereof. Therefore, it is understood that the recited game apparatuses and associated features are not limited to the particular implementations disclosed and that such alterations be covered under the present disclosure.

What is claimed is:

1. A beer pong game comprising:

a base with a playing surface that has (i) a first portion with a first designated area for cups and (ii) a second portion with a second designated area for cups, wherein the first portion includes a first end and the second portion includes a second end, the base having a length between the first end and the second end;

a game piece;

a tether that attaches the game piece to the base, wherein a first end of the tether is attached to the base at a location between the first designated area for cups and the second designated area for cups, and a second end of the tether is attached to the game piece, and wherein the tether has a length that is less than the length of the base; and a first launcher that includes a mechanism to launch the game piece as a projectile, the first launcher being positioned at or around the second end of the second portion to launch the game piece toward the first designated area for cups, wherein the first designated area for cups and at least a portion of the first launcher are within a range of the tether;

wherein the first designated area for cups comprises a central recess and a plurality of recesses arranged in a generally circular pattern around the central recess, the plurality of recesses including a first recess and a second recess that overlaps the first recess; and wherein the central recess is defined by a first protrusion, and wherein the first protrusion further defines, together with a second protrusion, at least in part, the first recess and the second recess.

2. The beer pong game of claim 1, further comprising a second launcher that is positioned at or around the first end of the first portion to launch the game piece toward the second designated area for cups, wherein the second designated area for cups and at least a portion of the second launcher are within the tether's range.

3. The beer pong game of claim 2, wherein:

the first launcher is positioned between the second designated area for cups and the second end of the second portion, and the second launcher is positioned between the first designated area for cups and the first end of the first portion.

4. The beer pong game of claim 1, further comprising:

a tray that is removably inserted into the one or more recesses, the tray being sized and shaped to hold the one or more arrangements of cups.

5. The beer pong game of claim 1, further comprising:

a plurality light sources that are positioned within the one or more recesses;

a power source to provide power to the plurality of light sources;

a plurality of switches that are positioned within the one or more recesses, each of the plurality of switches activating one or more light sources from the plurality of light sources upon insertion of a cup at a particular location in the one or more recesses and deactivating the one or more light sources upon removal of the cup from the particular location.

6. The beer pong game of claim 1, further comprising:

a light source that is located within the game piece; and a power source the provides power to power to the light source so as to illuminate the game piece, the power source being located either internally within the game piece or external to the game piece and supplying power to the light source through an electrical connection provided through the tether.

7. The beer pong game of claim 1, wherein the first launcher includes a top portion from which the game piece is launched and a bottom portion that is inserted into or otherwise mounted to the base.

8. The beer pong game of claim 7, wherein the second end of the second portion includes a plurality of mounting positions that are arranged laterally across the base near the second end, the bottom portion of the first launcher being removably inserted into or otherwise removably mounted to the base via at least one of the plurality of mounting positions.

9. The beer pong game of claim 8, wherein the plurality of mounting positions comprise a plurality of recesses that are defined by the playing surface.

10. The beer pong game of claim 7, wherein the top portion of the first launcher is laterally rotatable relative to the base.

11. The beer pong game of claim 1, wherein the mechanism comprises a spring that is connected, either directly or indirectly, to an arm that is adapted to cradle the game piece, wherein application and release of an external force greater than a threshold level to the spring causes the arm to launch the game piece as a projectile.

12. A beer pong game comprising:

a base with a playing surface that has (i) a first end with a first designated area for cups and (ii) a second end;

a game piece;

a tether that attaches the game piece to the base so as to permit the game piece to move freely within the tether's range, wherein the tether's range comprises a three-dimensional space that is defined by a length of the tether and a location on the base to which the tether is anchored;

a first launcher that includes a mechanism to launch the game piece as a projectile, the first launcher being positioned at or around the second end to launch the game piece toward the first designated area for cups, wherein the first designated area for cups and at least a portion of the first launcher are within the tether's range;

one or more base magnets that are affixed to or embedded within the base; and a tether magnet to which a first end of the tether is affixed, a second end of the tether being affixed to the game piece, wherein the tether magnet is magnetically coupled to the base at the location via the one or more base magnets.

13. The beer pong game of claim 1, wherein the game piece comprises a ball.

14. The beer pong game of claim 1, further comprising:

a hinge that rotatably adjoins the first portion to the send portion, the hinge having a range that includes, at least, (i) the base being in an unfolded configuration in which the playing surfaces of the first portion and second portion extend along a same plane and (ii) the base being in a folded configuration in which the playing surface of the first portion faces an opposite direction of the playing surface of the second portion.

15. A game apparatus comprising:

an elongated and planar game surface that defines one or more first recesses and one or more second recesses, wherein the first recesses and the second recesses are sized and shaped to each hold one or more arrangements of cups;

a ball;

a tether that connects the ball to the elongated and planar game surface, the tether including a first end that is attached to the game surface at a location between the one or more first recesses and the one or more second recesses, and a second end that is attached to the ball, and wherein the tether has a length that is shorter than a length of the elongated and planar game surface;

a first launcher that is located near a first end of the elongated and planar game surface, the first launcher including a first launching mechanism that is configured to launch the ball as a projectile toward the one or more second recesses; and a second launcher that is located near a second end of the elongated and planar game surface, the second end being opposite the first end, the second launcher including a second launching mechanism that is configured to launch the ball as a projectile toward the one or more first recesses;

wherein the first recesses comprises a central recess and a plurality of recesses arranged in a generally circular pattern around the central recess, the plurality of recesses including a first recess and a second recess that overlaps the first recess; and wherein the central recess is defined by a first protrusion, the first protrusion further defining, together with a second protrusion, at least in part, the first recess and the second recess.

16. The game apparatus of claim 15, further comprising:

a second ball;

a second tether that connects the second ball to the elongated and planar game surface.

17. The beer pong game of claim 1, further comprising one or more base magnets that are affixed to or embedded within the base, and further comprising a tether magnet that is affixed to the first end of the tether, wherein the tether magnet is magnetically coupled to at least one of the one or more base magnets.

18. The beer pong game of claim 1, wherein the first end of the tether is releasably attached to the base at a location between the first designated area for cups and the second designated area for cups.

19. The game apparatus of claim 15, wherein the first end of the tether is releasably attached to the game surface at a location between the one or more first recesses and the one or more second recesses.

20. The beer pong game of claim 1, wherein the first end of the tether is attached to the base at a location midway between the first designated area for cups and the second designated area for cups.

21. The game apparatus of claim 15, wherein the first end of the tether is attached to the base at a location midway between the one or more first recesses and the one or more second recesses.

22. The beer pong game of claim 1, wherein the first launcher is positioned between the second end of the second portion and the second designated area for cups.

23. The beer pong game of claim 1, wherein the first protrusion comprises a wall, and wherein the second protrusion comprises a wall.

24. The game apparatus of claim 15, wherein the first protrusion comprises a wall, and wherein the second protrusion comprises a wall.

* * * * *